US008899568B2

(12) United States Patent
Matsushita et al.

(10) Patent No.: US 8,899,568 B2
(45) Date of Patent: Dec. 2, 2014

(54) SHEET PROCESSING APPARATUS AND IMAGE FORMING SYSTEM

(71) Applicants: Shingo Matsushita, Tokyo (JP); Nobuyoshi Suzuki, Tokyo (JP); Takashi Saito, Kanagawa (JP); Satoshi Saito, Kanagawa (JP); Katsuhiro Kosuge, Kanagawa (JP); Makoto Hidaka, Tokyo (JP); Akihiro Musha, Kanagawa (JP); Shohichi Satoh, Kanagawa (JP); Ikuhisa Okamoto, Kanagawa (JP); Yuusuke Shibasaki, Kanagawa (JP); Takuya Morinaga, Tokyo (JP)

(72) Inventors: Shingo Matsushita, Tokyo (JP); Nobuyoshi Suzuki, Tokyo (JP); Takashi Saito, Kanagawa (JP); Satoshi Saito, Kanagawa (JP); Katsuhiro Kosuge, Kanagawa (JP); Makoto Hidaka, Tokyo (JP); Akihiro Musha, Kanagawa (JP); Shohichi Satoh, Kanagawa (JP); Ikuhisa Okamoto, Kanagawa (JP); Yuusuke Shibasaki, Kanagawa (JP); Takuya Morinaga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/855,141

(22) Filed: Apr. 2, 2013

(65) Prior Publication Data

US 2013/0264762 A1 Oct. 10, 2013

(30) Foreign Application Priority Data

Apr. 10, 2012 (JP) ..... 2012-089414
Jan. 31, 2013 (JP) ..... 2013-017520

(51) Int. Cl.
*B31F 1/07* (2006.01)
*B65H 39/00* (2006.01)
*B31F 5/02* (2006.01)
*B42B 5/00* (2006.01)

(52) U.S. Cl.
CPC *B65H 39/00* (2013.01); *B31F 1/07* (2013.01); *B31F 5/02* (2013.01); *B42B 5/00* (2013.01)
USPC ..... 270/58.08; 270/58.07

(58) Field of Classification Search
USPC ..... 270/37, 52.18, 58.07, 58.08; 399/408; 412/6, 33
See application file for complete search history.

(56) References Cited

U.S. PATENT DOCUMENTS

| | | | | |
|---|---|---|---|---|
| 8,235,375 | B2 * | 8/2012 | Shiraishi | 270/58.09 |
| 8,246,033 | B2 * | 8/2012 | Sato | 270/58.09 |
| 8,262,075 | B2 * | 9/2012 | Shiraishi | 270/58.09 |
| 8,342,499 | B2 * | 1/2013 | Shiraishi et al. | 270/58.08 |
| 2003/0006543 | A1 | 1/2003 | Tamura et al. | |

(Continued)

FOREIGN PATENT DOCUMENTS

| | | |
|---|---|---|
| JP | 36-013206 | 5/1961 |
| JP | 37-007208 | 4/1962 |

(Continued)

OTHER PUBLICATIONS

Extended European Search Report dated Aug. 6, 2013 issued in corresponding European Application No. 13162595.6.

*Primary Examiner* — Leslie A Nicholson, III
(74) *Attorney, Agent, or Firm* — Harness, Dickey & Pierce

(57) ABSTRACT

A sheet processing apparatus includes a stacking channel to stack multiple sheets into a sheet bundle, and a binding device to bind together the sheet bundle, the binding device including multiple clamping portions to clamp the sheet bundle to create multiple clamping marks on the sheet bundle. When the binding device binds a corner area of the sheet bundle, a longitudinal direction of each of the multiple clamping marks forms an angle within a range from 30 degrees to 60 degrees with a side of the corner area of the sheet bundle.

15 Claims, 19 Drawing Sheets

(56) References Cited

U.S. PATENT DOCUMENTS

| | | | |
|---|---|---|---|
| 2003/0057641 | A1 | 3/2003 | Yamada et al. |
| 2003/0151187 | A1 | 8/2003 | Tamura et al. |
| 2003/0160376 | A1 | 8/2003 | Saitoh et al. |
| 2003/0215275 | A1 | 11/2003 | Tamura et al. |
| 2003/0219295 | A1 | 11/2003 | Suzuki et al. |
| 2003/0234487 | A1 | 12/2003 | Yamada et al. |
| 2004/0070133 | A1 | 4/2004 | Yamada et al. |
| 2004/0104525 | A1 | 6/2004 | Suzuki et al. |
| 2011/0222945 | A1* | 9/2011 | Sato ..... 399/408 |
| 2011/0233843 | A1* | 9/2011 | Shiraishi ..... 270/58.09 |
| 2011/0233844 | A1* | 9/2011 | Shiraishi et al. ..... 270/58.11 |
| 2011/0236158 | A1* | 9/2011 | Shiraishi ..... 412/33 |

FOREIGN PATENT DOCUMENTS

| | | |
|---|---|---|
| JP | 2004-155537 | 6/2004 |
| JP | 2005-074858 | 3/2005 |
| JP | 2010-274623 | 12/2010 |

* cited by examiner

SHEET PROCESSING APPARATUS AND IMAGE FORMING SYSTEM

CROSS-REFERENCE TO RELATED APPLICATIONS

This patent application is based on and claims priority pursuant to 35 U.S.C. §119 to Japanese Patent Application Nos. 2012-089414, filed on Apr. 10, 2012, and 2013-017520, filed on Jan. 31, 2013, in the Japan Patent Office, the entire disclosure of each of which is hereby incorporated by reference herein.

BACKGROUND OF THE INVENTION

1. Field of the Invention

The present invention generally relates to a sheet processing apparatus to bind together a bundle of sheets and an image forming system including the sheet processing apparatus and an image forming apparatus, such as a copier, a facsimile machine, a printer, or multifunction machine capable of at least two of these functions.

2. Description of the Background Art

There are sheet processing apparatuses, so-called finishers or post-processing apparatuses, that align a bundle of sheets (hereinafter "a sheet bundle") output from an image forming apparatus and bind the sheet bundle with metal staples. Such sheet processing apparatuses can automatically staple a number of sheet bundles on which images are formed and are widely used for convenience and efficiency thereof.

Additionally, there are hand-held staplers, so-called staple guns or powered staplers, capable of binding sheets without metal staples. For example, there are hand-held staplers that press multiple sheets with a tooth form so that fibers of the sheets tangle with each other and thereby tie the sheets together, or bind the sheets together using other types of processing such as half blanking, lancing, bending, and inserting. Such binding tools can reduce consumption of consumables, make recycling easier, and be effective to save resources because sheets bound by them are free of metal staples and can be directly put through a shredder.

It is to be noted that, hereinafter clamp binding refer to a binding method that involves pressing multiple sheets with a tooth form to tie the sheets, thereby causing fibers of the sheets to tangle with each other. The portions where the fibers are tangled are referred to as "clamping marks". For example, JP-S36-13206-Y discloses a hand-held stapler capable of clamp binding, and JP-S37-7208-Y discloses a hand-held stapler that makes cut holes in sheets, bends cut portions, and inserts the cut portions into the cut holes.

Use of clamp binding in sheet processing apparatuses is expected to increase owing to the above-described advantages. The strength of binding by clamp binding, however, is lower than that attained by metal staples, and, if the sheet bundle is handled roughly, the clamping marks might be loosened, allowing the sheet to come off from the sheet bundle. To enhance the binding strength of clamp binding, for example, JP-2004-15537-A proposes changing the number or arrangement of tooth of the tooth form depending on variables relating to the sheets bound thereby.

SUMMARY OF THE INVENTION

In view of the foregoing, an aim of the present invention is to provide a sheet processing apparatus and an image forming system capable of performing clamp binding that is less separable when a sheet of a sheet bundle is turned.

One embodiment of the present invention provides a sheet processing apparatus that includes a stacking channel to stack multiple sheets into a sheet bundle, and a binding device to bind together the sheet bundle. The binding device includes multiple clamping portions to clamp the sheet bundle to create multiple clamping marks on the sheet bundle. When the binding device binds a corner area of the sheet bundle, a longitudinal direction of each of the multiple clamping marks forms an angle within a range from 30 degrees to 60 degrees with a side of the corner area of the sheet bundle.

In another embodiment, in a sheet processing apparatus including the above-described and the above-described binding device, when a binding device binds a center area along a binding side of the sheet bundle, a longitudinal direction of each of the multiple clamping marks is substantially perpendicular to the binding side of the sheet bundle.

In yet another embodiment, an image forming system includes an image forming apparatus and either of the above-described sheet processing apparatuses.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1B:
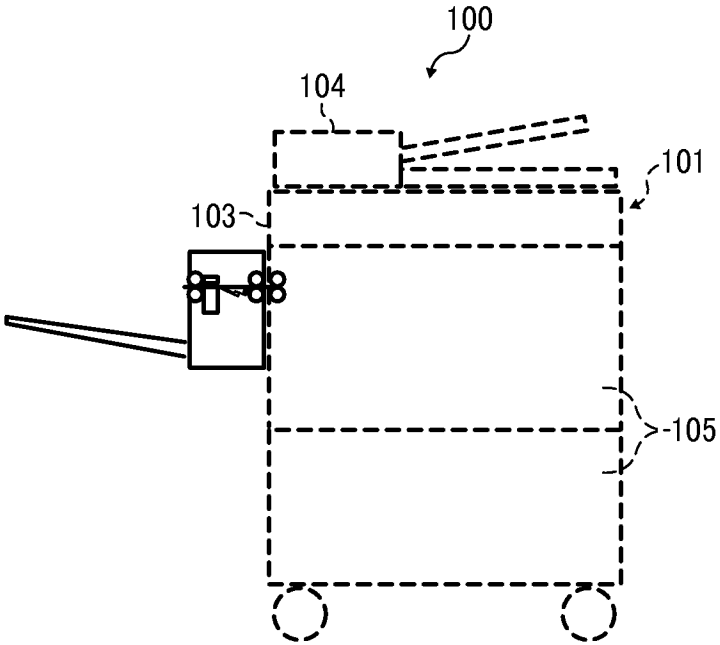
FIGS. 1A and 1B are schematic diagrams illustrating two states of an image forming system according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a system including an image forming apparatus and a sheet according to an embodiment of the present invention is described.

In the embodiment described below, the direction in which a bundle of sheets is bound (i.e., arrangement direction of multiple clamping portions, in particular, clamping tooth) is determined according to the direction in which the sheets are turned over to provide sheet bundles in which sheets are not easily separated without changing a clamp binding mechanism.

It is to be noted that other aims, configurations, and effects of the present embodiment are also given in the description below.

Figure 1A:
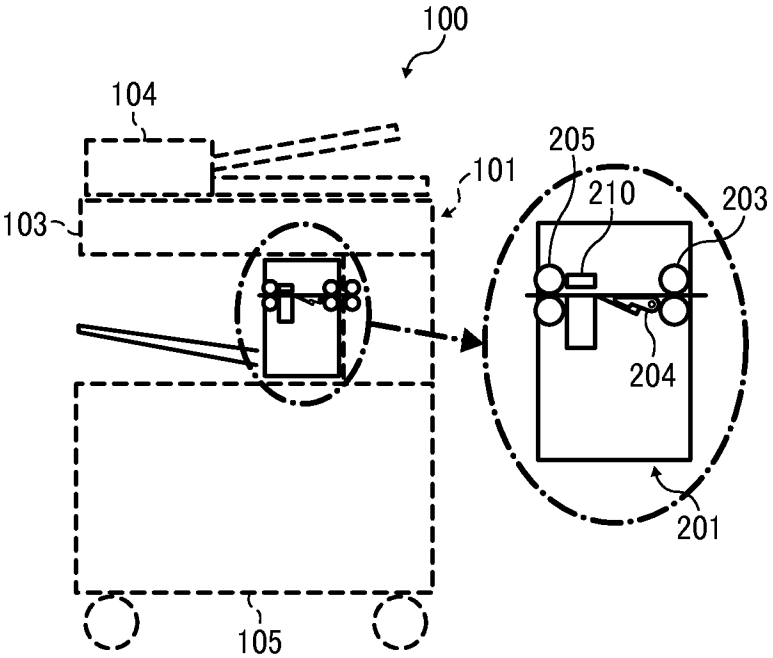

FIGS. 1A and 1B are schematic diagrams illustrating two states of an image forming system according to an embodiment of the present invention. An image forming system 100 according to the present embodiment includes an image forming apparatus 101 and a sheet processing apparatus (i.e., a finisher or post-processing apparatus) 201. The sheet processing apparatus 201 includes a sheet binding mechanism and disposed inside a conveyance channel through which sheets are output from the image forming apparatus 101. Thus, the sheet processing apparatus 201 is a channel-internal binding apparatus. The sheet processing apparatus 201 is disposed inside the conveyance channel of the image forming apparatus 101 in FIG. 1A and outside the conveyance channel in FIG. 1B. The sheet processing apparatus 201 has two capabilities, aligning sheets stacked inside the conveyance channel and stapling the sheets inside the conveyance channel. In FIG. 1A, the sheet processing apparatus 201 processes sheets inside the housing of the image forming apparatus 101 and thus is also called a housing-internal processing device. Thus, the sheet processing apparatus 201 according to the present embodiment is compact and can be mounted inside the housing or to a side of the image forming apparatus 101 in accordance with the configuration thereof.

The image forming apparatus 101 includes an image forming engine 105, an image reader 103 to read and convert images into image data, and an automatic document feeder (ADF) 104. The image forming engine 102 includes an image processing unit and a sheet feeder. In the state shown in FIG. 1A, a discharge tray to which sheets on which images are formed are output is formed inside the housing of the image forming apparatus 101. In the state shown in FIG. 1B, the discharge tray is positioned outside the image forming apparatus 101.

Figure 2:
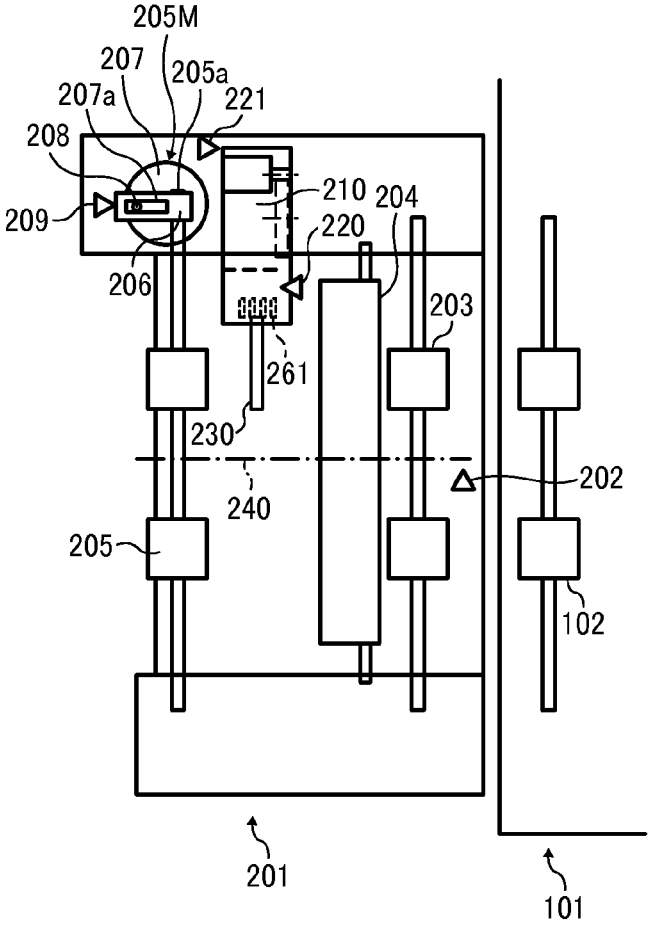
FIG. 2 is a plan view of a sheet processing apparatus shown in FIGS. 1A and 2B.
Figure 3:
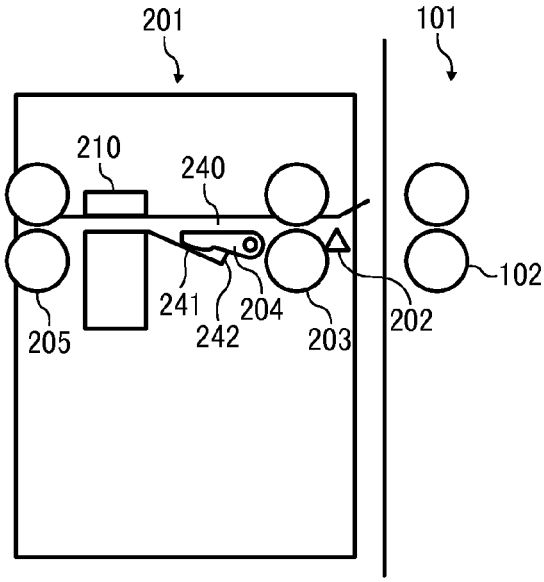
FIG. 3 is a front view of the sheet processing apparatus shown in FIGS. 1A and 1B.

FIGS. 2 and 3 are respectively a plan view and a front view of the sheet processing apparatus 201 shown in FIGS. 1A and 2B. In the configuration shown in FIGS. 2 and 3, the sheet processing apparatus 201 includes an entry detector 202, a pair of entrance rollers 203, a branch pawl 204, a binding device 210, and a pair of discharge rollers 205, and these components are arranged in that order from an entrance side along a conveyance channel 240. The entry detector 202 detects the presence of a sheet received in the sheet processing apparatus 201 after discharged from the image forming apparatus 101. Specifically, the entry detector 202 detects the leading end and the trailing end of the sheet. For example, the entry detector 202 can be a reflection type photosensor. Alternatively, a transmission-type photosensor may be used. The entrance rollers 203 are positioned at the entrance of the sheet processing apparatus 201 to receive sheets discharged by discharge rollers 102 of the image forming apparatus 101 and forward the sheets to the binding device 210. Additionally, a drive source, such as a drive motor, is provided for the entrance rollers 203 and a controller, such as a central processing unit (CPU) controls the stop, rotation, and a conveyance amount of the drive source. The entrance rollers 203 correct skew of the sheet with the leading end of the sheet stuck in a nip between the entrance rollers 203.

The branch pawl 204 is disposed downstream from the entrance rollers 203 in the direction in which the sheet is transported (hereinafter "sheet conveyance direction"). The branch pawl 204 guides the trailing end of the sheet to a bifurcation channel 241. In this case, after the trailing end of the sheet passes by the branch pawl 204, the branch pawl 204 pivots clockwise in FIG. 3, thereby transporting the sheet in reverse. Thus, the trailing end of the sheet is led to the bifurcation channel 241. The branch pawl 204 can pivot driven by a solenoid 250 shown in FIG. 4, which is described in further detail later. Instead of the solenoid 250, a motor may be used. When the branch pawl 204 pivots counterclockwise in FIG. 3, the branch pawl 204 can press a single sheet or multiple sheets against a conveyance face of the bifurcation channel 241. Thus, the branch pawl 204 can retain the single or multiple sheets not to move in the bifurcation channel 241.

The discharge rollers 205 are disposed immediately upstream from the exit of the conveyance channel 240 of the sheet processing apparatus 201. The discharge rollers 205 transport, shift, and discharge the sheets. A drive source for the discharge rollers 205 is provided similarly to the entrance rollers 203, and the controller controls the stop, rotation, and a conveyance amount thereof. A shift mechanism 205M (shown in FIG. 2) shifts the discharge rollers 205. The shift mechanism 205M includes a shift link 206, a shift cam 207, a cam stud 208, and a home position (HP) detector 209.

The shift link 206 is provided to a shaft end 205*a* of the discharge rollers 205 and receives a force for shifting the discharge rollers 205. The shift cam 207 is a rotary disc-shaped member and includes the cam stud 208. For example, the shaft of the discharge rollers 205 is movably inserted into a shift link slot 207*a* via the cam stud 208, and the discharge rollers 205 are moved in a direction perpendicular to the sheet conveyance direction by rotation of the shift cam 207. Thus, the discharge rollers 205 are shifted. The cam stud 208 is geared to the shift link slot 207*a* and converts the rotational motion of the shift cam 207 to linear movement in the axial direction of the discharge rollers 205. The HP detector 206 detects a position of the shift link 206, and the detected position is deemed a home position of the shift link 206, used as a reference to control rotation of the shift cam 207. The rotation of the shift is controlled by the above-described controller.

The binding device 210 includes a sheet end detector 220, a binding home position (HP) detector 221, and a guide rail 230 to guide movement of the binding device 210. The binding device 210 is a so-called stapler to bind together multiple sheets into a sheet bundle. In the present embodiment, the binding device 210 squeezes sheets using a pair of tooth forms 261, thereby deforming the sheets so that fibers thereof tangle each other. This is called clamp binding. There are hand-held staplers to binds sheets using half blanking, lancing, bending, and inserting in addition to clamp binding. Such binding methods without metal staplers reduce consumption of consumables, make recycling easier, and enable shredding of sheet bundles as is. Therefore, such binding methods in which sheets are bound using sheets alone is preferable also in sheet processing apparatuses.

The sheet end detector 220 detects a lateral end of the sheet, and sheets are aligned with reference to the position detected by the sheet end detector 220. The binding HP detector 221 is movable in a sheet width direction perpendicular to the sheet conveyance direction and detects a position of the binding device 210. The home position of the binding device 210 is set to a position not to interfere with a maximum size sheet processed by the image forming system 100. The guide rail 230 guides the binding device 210 so that the binding device 210 can move reliably in the sheet width direction. The guide rail 230 extends in a range to guide the binding device 210 moving in the direction perpendicular to the conveyance channel 240 (sheet conveyance direction) from the home position to a position to binds a smallest sheets processed by the image forming system 100. A shift unit including a drive motor moves the binding device 210 along the guide rail 230.

The conveyance channel 240 extends from the entrance of the sheet processing apparatus 201 to the exit thereof. The bifurcation channel 241 bifurcates from the conveyance channel 240. The sheet is transported in reverse (switchback) and transported from the trailing end to the bifurcation channel 241. The bifurcation channel 241 serves as a stacking unit to stack and align multiple sheets. The sheets are transported so that the trailing ends thereof contact a contact face 242 provided at a downstream end of the bifurcation channel 241. Thus, the contact face 242 serves as a reference plane to align the trailing end of the sheets. The pair of tooth forms 261 in the present embodiment has multiple projections and multiple recesses mating with each other. The pair of tooth forms 261 squeezes the sheets for clamp binding.

Figure 4:
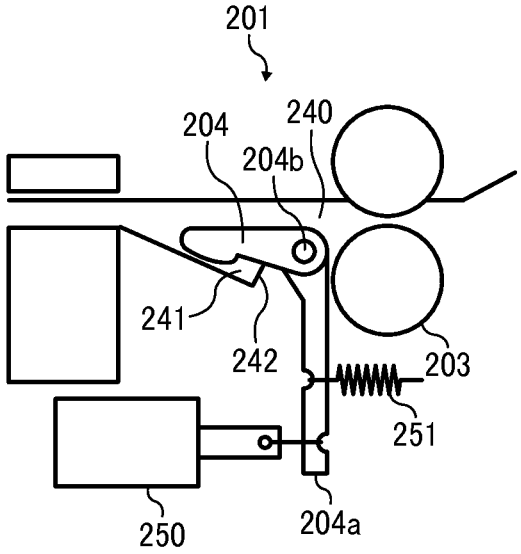
FIG. 4 is a schematic diagram illustrating a main portion of the sheet processing apparatus when a branch pawl is at a position for transporting sheets.
Figure 5:
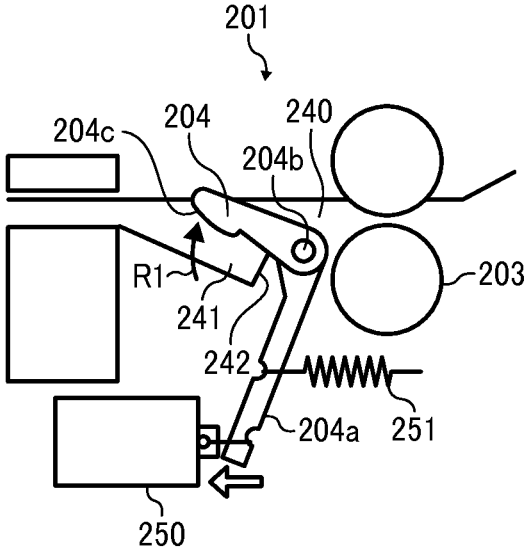
FIG. 5 is a schematic diagram illustrating the main portion of the sheet processing apparatus when the branch pawl is at a position for switchback operation.

FIGS. 4 and 5 are schematic diagram illustrating a main portion around the branch pawl 204 of the sheet processing apparatus 201. FIG. 4 illustrates a state in which the branch pawl 204 forwards the sheet along the conveyance channel 240, and FIG. 5 illustrates switchback operation. The branch pawl 204 is pivotable in a predetermined angle range relative to a support shaft 204*b* to switch the sheet conveyance route between the conveyance channel 240 and the bifurcation channel 241. The position of the branch pawl 204 shown in FIG. 4 serves as a home position to forward the sheet received from the right in FIG. 4 to the downstream side without interfering it. A spring 251 constantly and elastically biases the branch pawl 204 counterclockwise in FIG. 4.

The spring 251 is hooked to a lever 204*a* to which a plunger of the solenoid 250 is connected. It is to be noted that the sheet can be kept clamped inside the bifurcation channel 241 when the branch pawl 204 returns to the position shown in FIG. 4 after the sheet is transported to the branch pawl 204 in the state shown in FIG. 5. The conveyance route can be switched by turning on and off the solenoid 250. Specifically, as the solenoid 250 turns on, the branch pawl 204 rotates in the direction indicated by arrow R1 shown in FIG. 5, blocking the conveyance channel 240 and opening the bifurcation channel 241. Thus, the sheet is led to the bifurcation channel 241.

Figure 6:
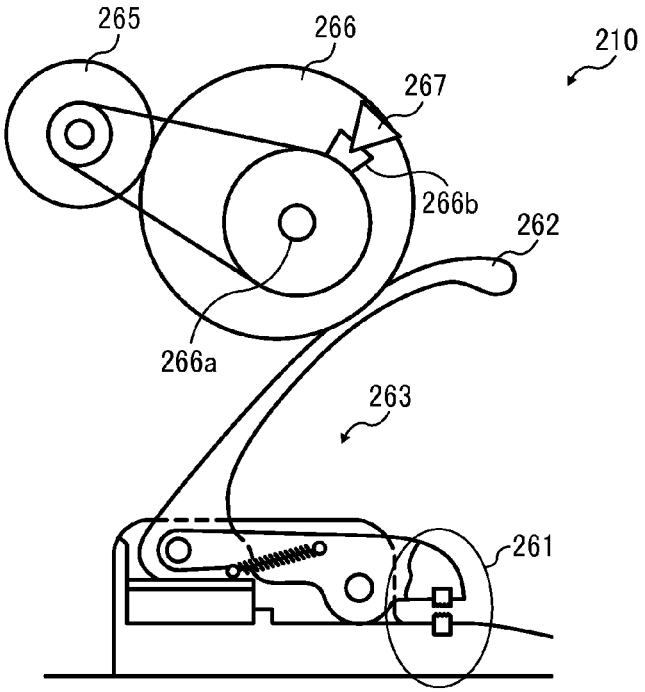
FIG. 6 is a schematic view of a binding device at a position for receiving sheets.
Figure 7:
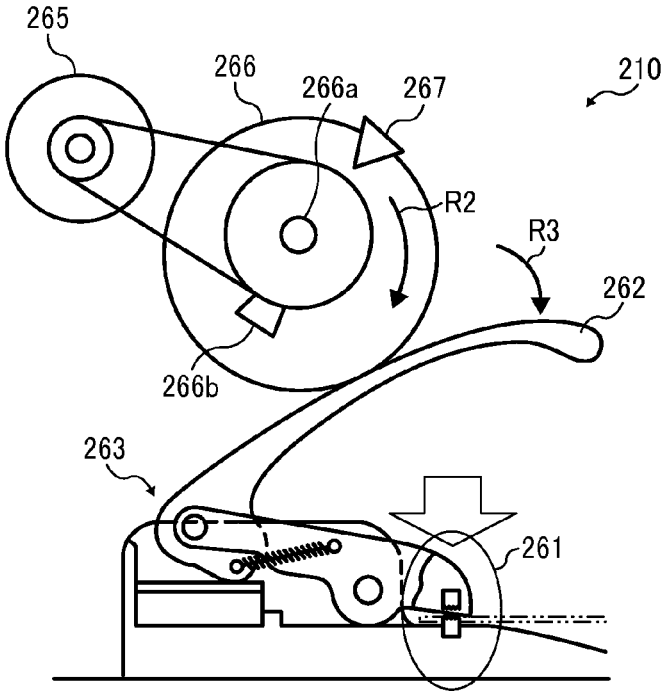
FIG. 7 is a schematic view of the binding device at a position for binding sheets.

FIGS. 6 and 7 illustrate a configuration of the binding device 210 according to the present embodiment. The binding device 210 includes the pair of tooth forms 261, a pressure lever 262, a group of links 263, a drive motor 265, an eccentric cam 266, and a cam home position (HP) detector 267. The tooth forms 261 are arranged vertically in pair and shaped to engage each other. The pair of tooth forms 261 is positioned at an output end of the group of links 263 combined together, and the pressure lever 262 is positioned at an input end (driving end) of the group of links 263. The tooth forms 261 engage and are disengaged from each other as the pressure lever 262 applies pressure to and release the pressure.

The pressure lever 262 is rotated by the eccentric cam 266. The drive motor 265 drives the eccentric cam 266, and the rotational position thereof is controlled with reference to detection by the cam HP detector 267. The rotational position of the eccentric cam 266 defines the distance from a rotation axis 266*a* and to a cam surface thereof, based on which the pressing amount by the pressure lever 262 is determined. The home position of the eccentric cam 266 is set to a position at which a feeler 266*b* provided to the eccentric cam 266 is detected by the cam HP detector 267. As shown in FIG. 6, when the eccentric cam 266 is at the home position, the tooth forms 261 are disengaged from each other. In this state, binding is not feasible and sheets can be received in the binding device 210.

For binding sheets, the sheets are inserted between the tooth forms 261 at the position shown in FIG. 6, and then the drive motor 265 rotates. When the drive motor 265 starts rotating, the eccentric cam 266 rotates in the direction indicated by arrow R2 shown in FIG. 7. As the eccentric cam 266 rotates, the cam surface thereof shifts, and the pressure lever 262 rotates in the direction indicated by arrow R3 shown in FIG. 7. The force of rotation increases in strength through the group of links 263 using leverage and is transmitted to the pair of tooth forms 261 at the output end.

When the eccentric cam 266 rotates a predetermined amount, the upper and lower tooth forms 261 engage each other, thus squeezing the sheets interposed therebetween. The squeezed sheets deform, and fibers of adjacent sheets tangle each other. Subsequently, the drive motor 265 rotates in reverse and stops in response to a detection result generated by the cam HP detector 267. Then, the upper and lower tooth forms 261 return to the state shown in FIG. 6 and become capable of transporting the sheets. The pressure lever 262 has a capability of spring and can deform to let an excessive load out when the excessive load is applied thereto.

FIGS. 8A through 16B illustrate online binding operation performed by the binding device 210 of the sheet processing apparatus 201. Among FIGS. 8A through 16B, the drawings given number with subscript "A" are plan views, and drawings given number with subscript "B" are front views. Additionally, the term "online binding" means that, after the image forming apparatus 101 forms images on the sheets, the sheets are consecutively received by the sheet processing apparatus 201 disposed at the discharge port of the image forming apparatus 101, aligned, and bound thereby. By contrast, the term "independent binding" and "offline binding" mean that the binding device 210 of the sheet processing apparatus 201 binds sheets independently from the image forming apparatus 101, and the sheets thus bound are not limited to those outputs from the image forming apparatus 101. Offline binding is not consecutive with image formation by the image forming apparatus 101.

Figure 8A:
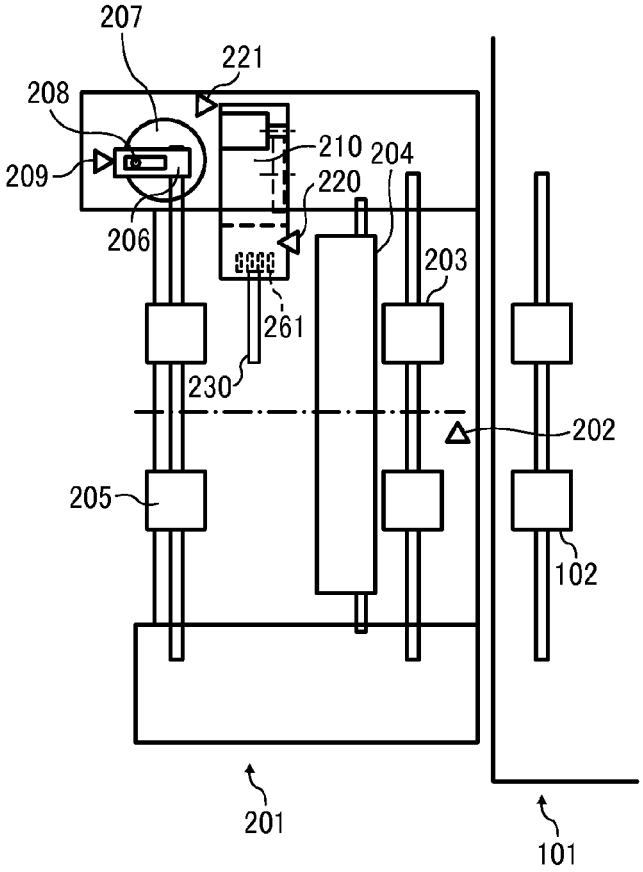
FIGS. 8A and 8B illustrate the sheet processing apparatus being in an initial stage of online binding.
Figure 8B:
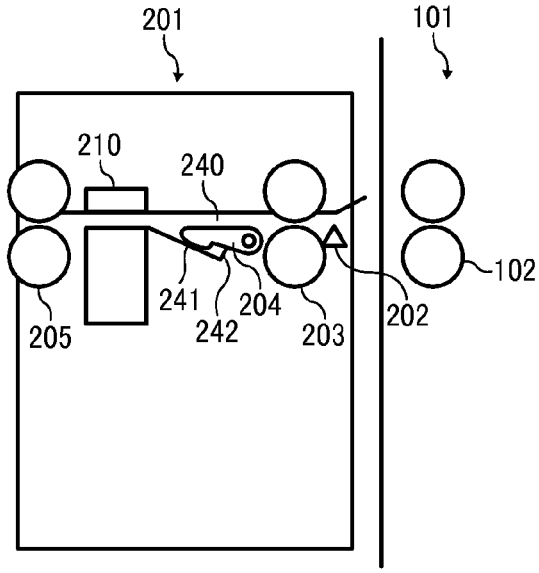

FIGS. 8A and 8B illustrate the sheet processing apparatus 201 being in an initial stage of online binding. Referring to FIGS. 8A and 8B, when the image forming apparatus 101 starts outputting sheets, the respective components of the sheet processing apparatus 201 move to their home positions, thus completing the initial stage.

Figure 9A:
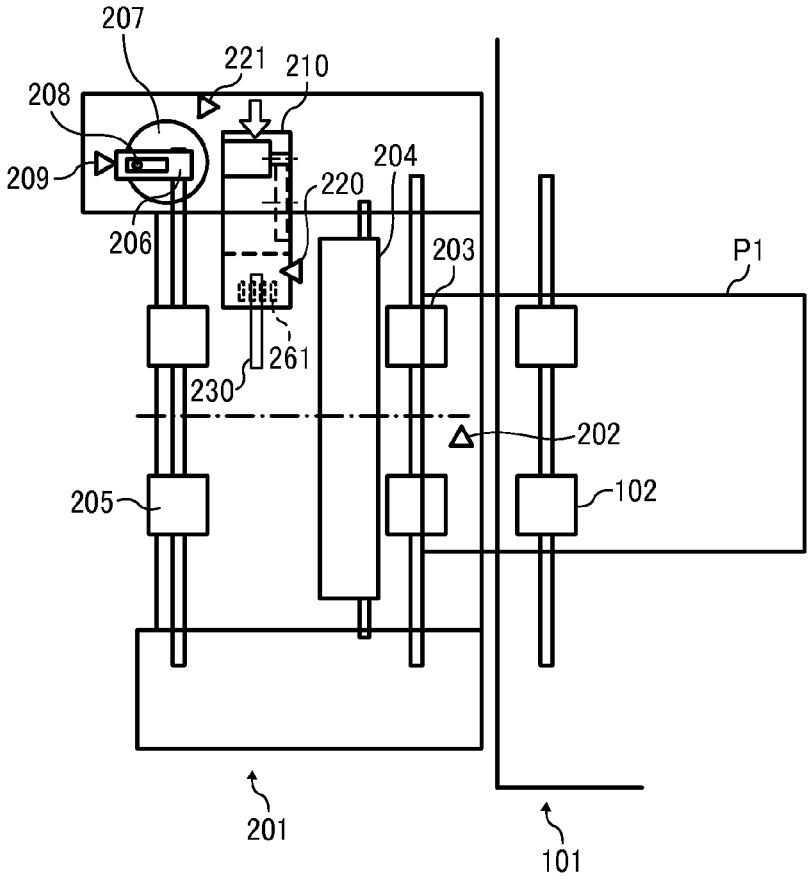
FIGS. 9A and 9B illustrates a state immediately after a first sheet output from an image forming apparatus is received in the sheet processing apparatus.
Figure 9B:
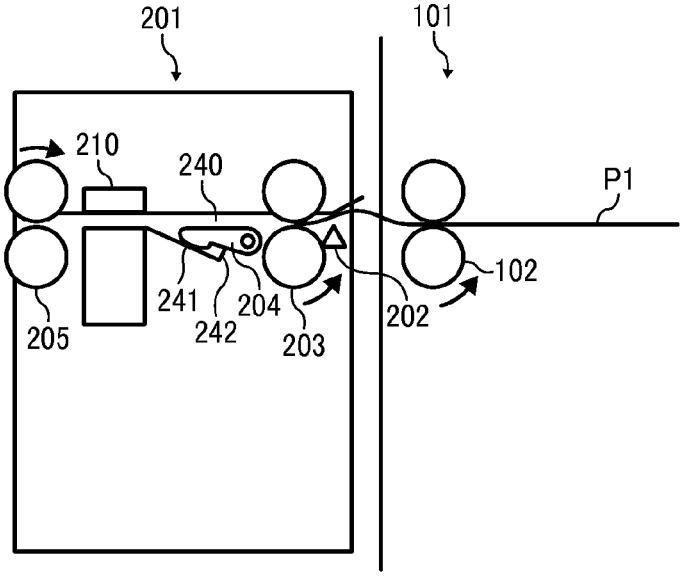

FIGS. 9A and 9B illustrates a state immediately after a first sheet P1 output from the image forming apparatus 101 is received in the sheet processing apparatus 201. Before the first sheet P1 is received by the sheet processing apparatus 201, the controller of the sheet processing apparatus 201 obtains sheet processing data such as processing type and sheet data (sheet-related variables) and enters a standby state for receiving sheets according to the data.

The processing types include straight transport, shifted discharge, and binding. For the straight transport, the entrance rollers 203 and the discharge rollers 205 start rotating in the sheet conveyance direction in the standby state, and the first sheet P1 through a last sheet Pn are transported sequentially. After the last sheet Pn is discharged, the entrance rollers 203 and the discharge rollers 205 stop. It is to be noted that "n" is an integer equal to greater than "2".

For the shifted discharge, the entrance rollers 203 and the discharge rollers 205 start rotating in the sheet conveyance direction in the standby state. In the shifted discharge, after the trailing end of the first sheet P1 exits from the entrance rollers 203, the shift cam 207 rotates a predetermined amount, and the discharge rollers 205 move in the axial direction. At that time, the first sheet P1 moves together with the discharge rollers 205. After the first sheet P1 is discharged, the shift cam 207 rotates to the home position and is prepared for the subsequent sheet. This shifting operation is repeated until the last sheet Pn of that copy (a bundle) is discharged. Thus, a bundle of sheets, to be bound into a sheet bundle 272, is stacked, shifted to one side. When a first sheet P1 of a subsequent copy is received, the shift cam 207 rotates in the direction reverse to the direction for the previous copy.

For binding, in the standby state, the entrance rollers 203 are motionless, and the discharge rollers 205 start rotating in the sheet conveyance direction. Additionally, the binding device 210 moves to a standby position withdrawn a predetermined amount from the sheet width and goes standby. In this case, the entrance rollers 203 also serve as a pair of registration rollers. Specifically, the first sheet P1 is received in the sheet processing apparatus 201. Then, the leading end of the sheet is detected by the entry detector 202 and gets stuck in the nip between the entrance rollers 203. Further, with the leading end thereof stuck in the entrance rollers 203, the first sheet P1 is transported by the discharge rollers 102 of the image forming apparatus 101 by an amount to cause slackening. Subsequently, the entrance rollers 203 start rotating. Thus, skew of the first sheet P1 is corrected. FIGS. 9A and 9B illustrate this state.

Figure 10A:
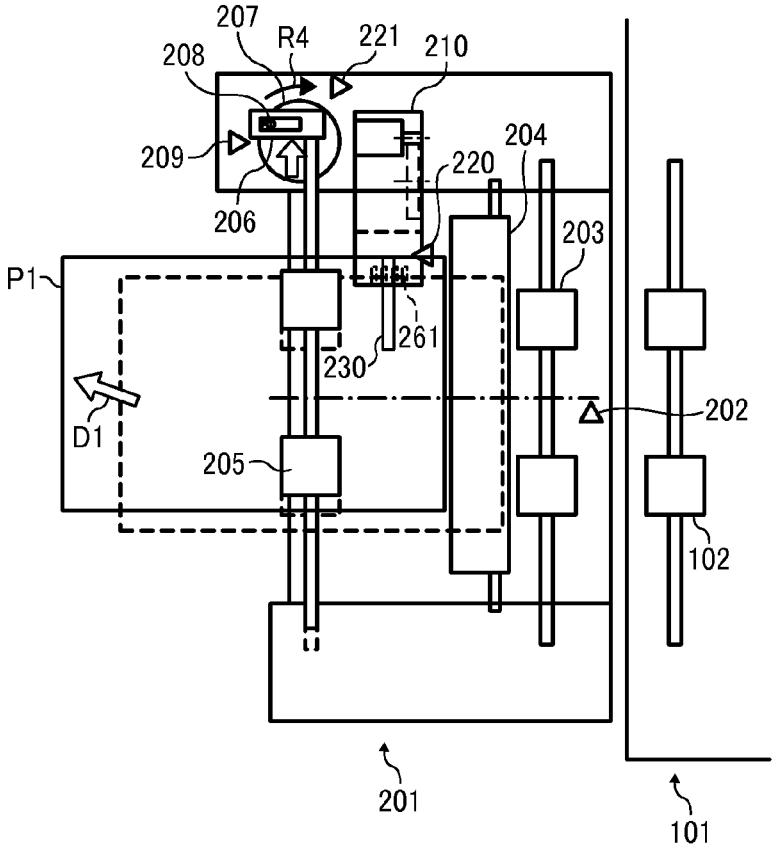
FIGS. 10A and 10B illustrate a state in which the trailing end of the sheet released from a nip between a pair of entrance rollers is beyond a bifurcation channel.
Figure 10B:
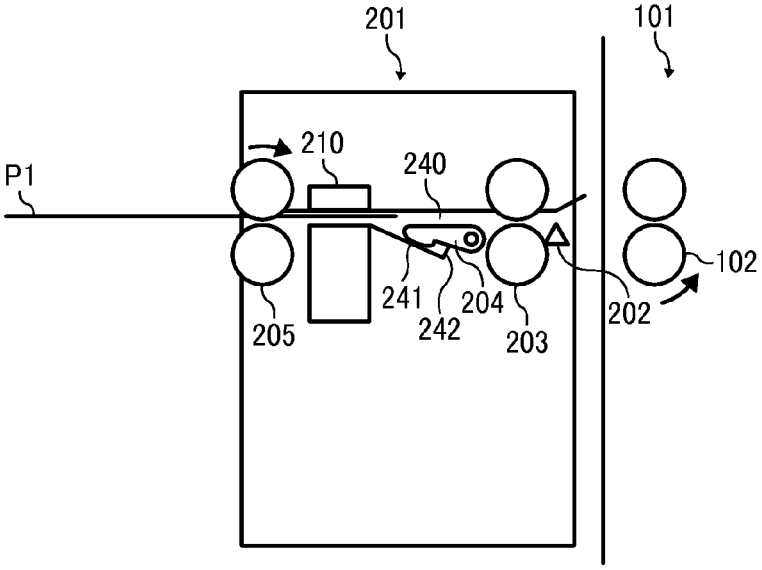

FIGS. 10A and 10B illustrates a state in which the trailing end of the sheet is released from the nip between the entrance rollers 203 and gets beyond the bifurcation channel 241. The conveyance amount of the first sheet P1 is measured based on the detection of the trailing end of the sheet by the entry detector 202, and thus the controller recognizes the position of the first sheet P1. After the trailing end of the sheet passes by the nip between the entrance rollers 203, the entrance rollers 203 stop rotating to receive the second sheet P2. Simultaneously, the shift cam 207 rotates in the direction indicated by arrow R4 shown in FIG. 10A (clockwise in FIG. 10A). The discharge rollers 205 start moving in the axial direction with the first sheet P1 clamped in the nip thereof. Thus, the first sheet P1 is transported while being moved obliquely as indicated by arrow D1 in FIG. 10A, obliquely to the sheet conveyance direction. Subsequently, when the sheet end detector 220, disposed adjacent to or incorporated in the binding device 210, detects the lateral end of the sheet P, the shift cam 207 stops and rotates in reverse. Then, the shift cam 207 stops in a state in which the sheet end detector 220 does not detect the presence of the sheet P. When the trailing end of the sheet P reaches a predetermined position beyond a leading end of the branch pawl 204, the discharge rollers 205 stop.

Figure 11A:
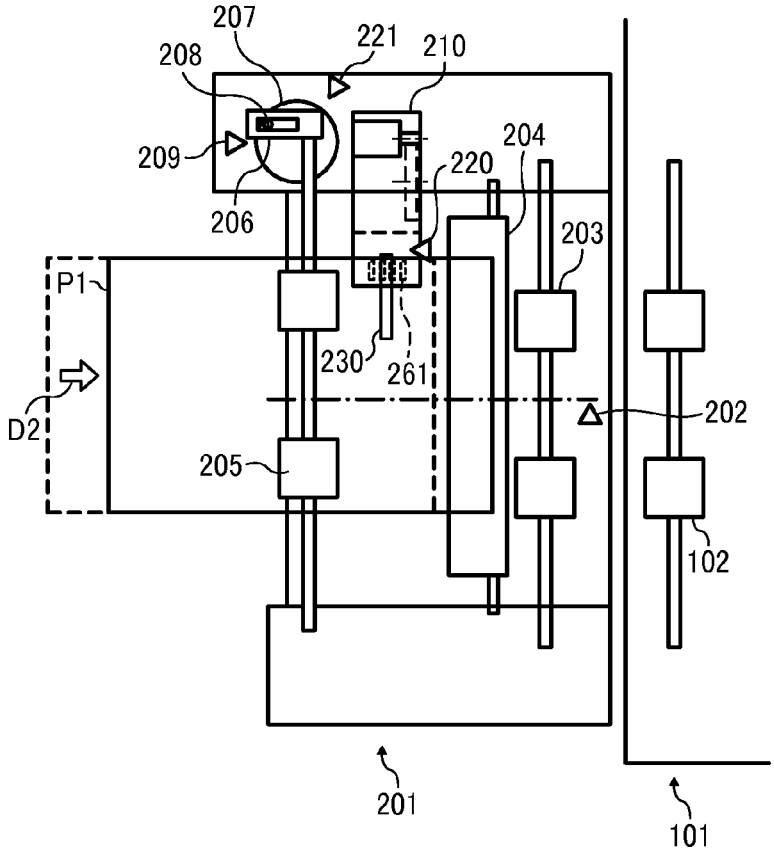
FIGS. 11A and 11B illustrate the switchback operation for changing a conveyance route in which the sheet is transported.
Figure 11B:
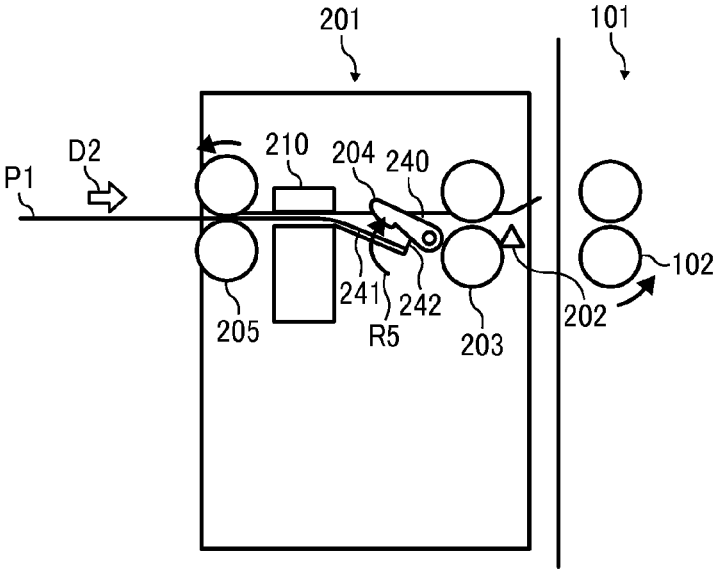

FIGS. 11A and 11B illustrate the switchback operation for changing the conveyance route in which the sheet P1 is transported. Subsequent to the state shown in FIGS. 10A and 10B, the branch pawl 204 is rotated in the direction indicated by arrow R5 shown in FIG. 11B to switch the conveyance route to the bifurcation channel 241, after which the discharge rollers 205 are rotated in reverse. With this operation, the first sheet P1 is switchbacked in the direction indicated by arrow D2 (hereinafter "direction D2"), and the trailing end of the first sheet P1 enters the bifurcation channel 241. Further, the trailing end of the sheet contacts the contact face 242 and is aligned with reference to the contact face 242. When the first sheet P1 is thus aligned, the discharge rollers 205 stop. At that time, the discharge rollers 205 slip as the trailing end of the first sheet P1 contacts the contact face 242 so as not to apply conveyance force thereto. In other words, the discharge rollers 205 no longer buckle the first sheet P1 after the trailing end of the switchbacked first sheet P1 is aligned by the contact face 242.

Figure 12A:
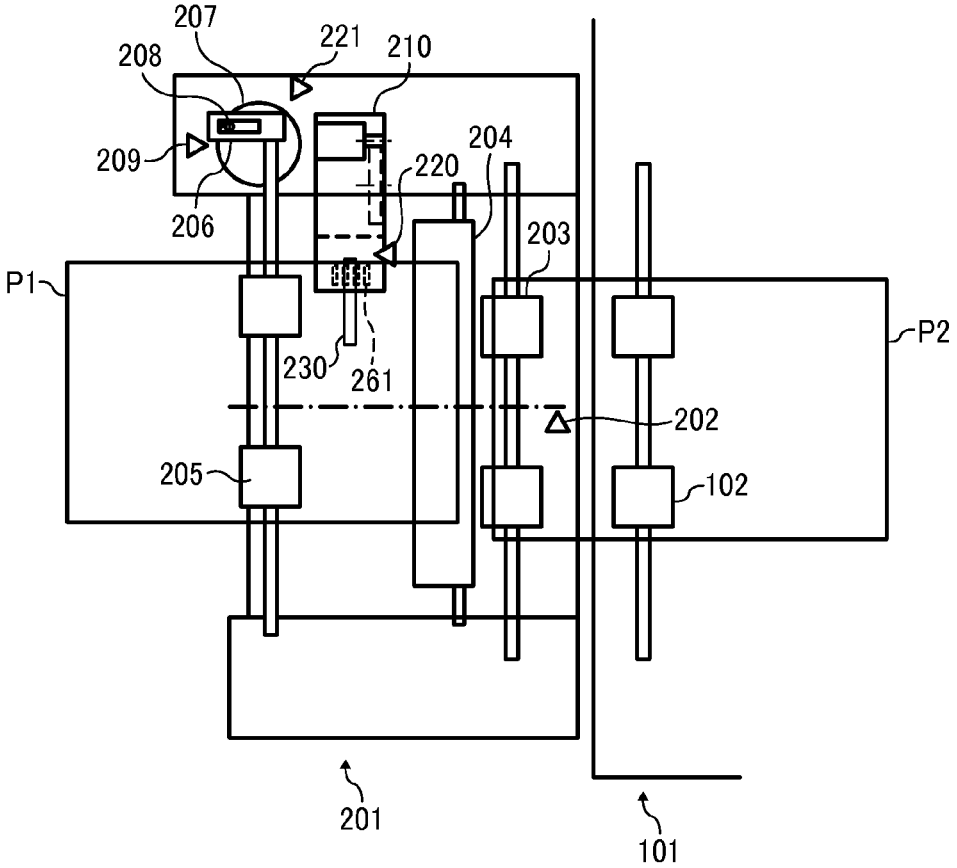
FIGS. 12A and 12B illustrate a state in which the first sheet is retained in the bifurcation channel, and a second sheet is received in the sheet processing apparatus.
Figure 12B:
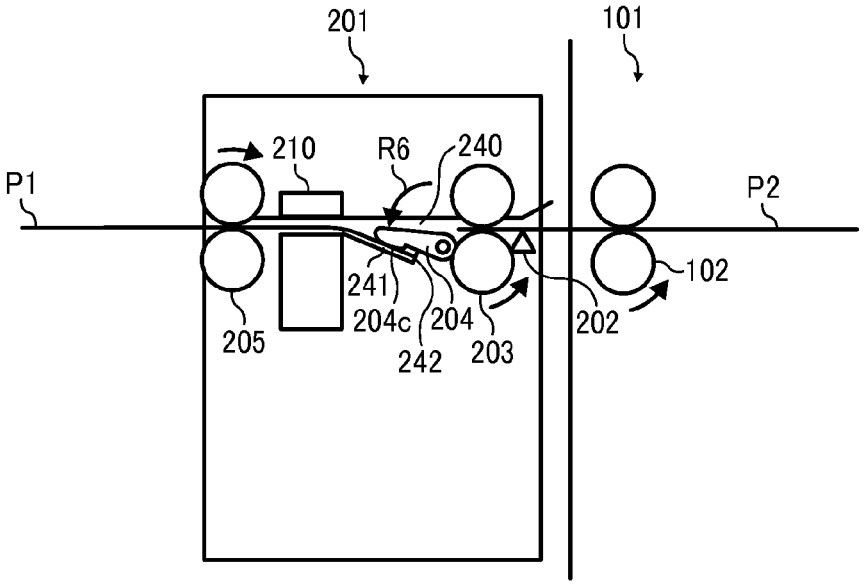

FIGS. 12A and 12B illustrate a state in which the first sheet P1 is retained in the bifurcation channel 241, and the second sheet P2 is received in the sheet processing apparatus 201. After the preceding first sheet P1 is aligned by the contact face 242, the branch pawl 204 rotates in the direction indicated by arrow R6 shown in FIG. 12B. With this operation, a lower face 204*c* (hereinafter "pressing face 204*c*") of the branch pawl 204 presses the trailing end of the sheet, which is positioned in the bifurcation channel 241, against a lower face of the bifurcation channel 241 to keep the first sheet P1 from moving. When the second sheet P2 is received from the image forming apparatus 101, the entrance rollers 203 correct skew thereof similarly to the first sheet P1. Subsequently, the entrance rollers 203 and the discharge rollers 205 start rotating in the sheet conveyance direction simultaneously.

Figure 13A:
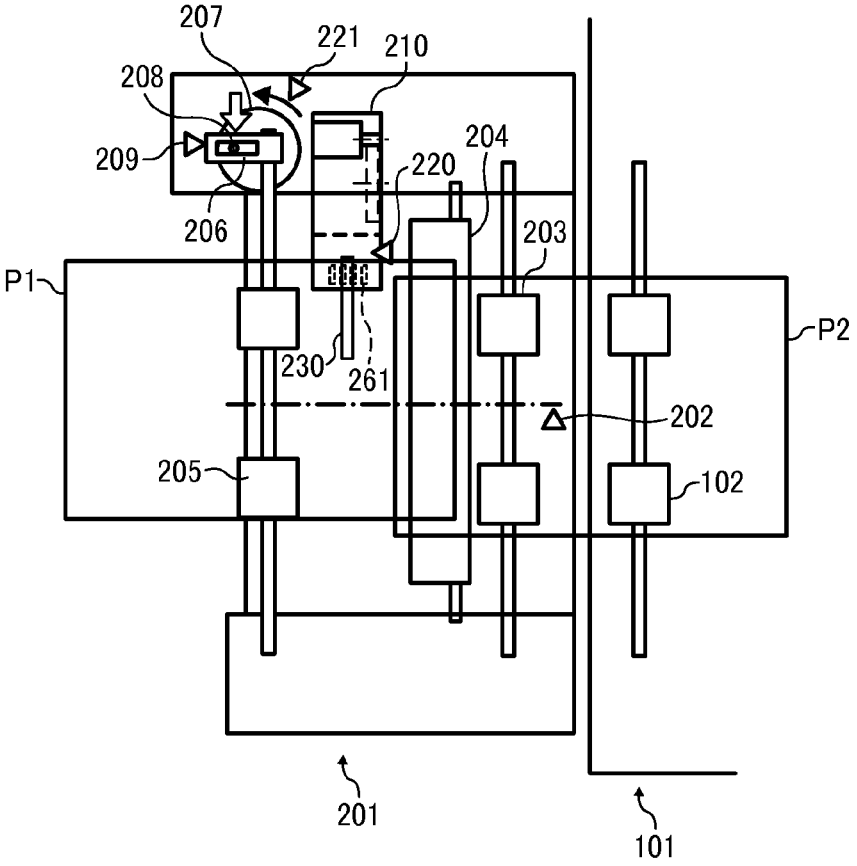
FIGS. 13A and 13B illustrate a state in which the second sheet is received in the sheet processing apparatus.
Figure 13B:
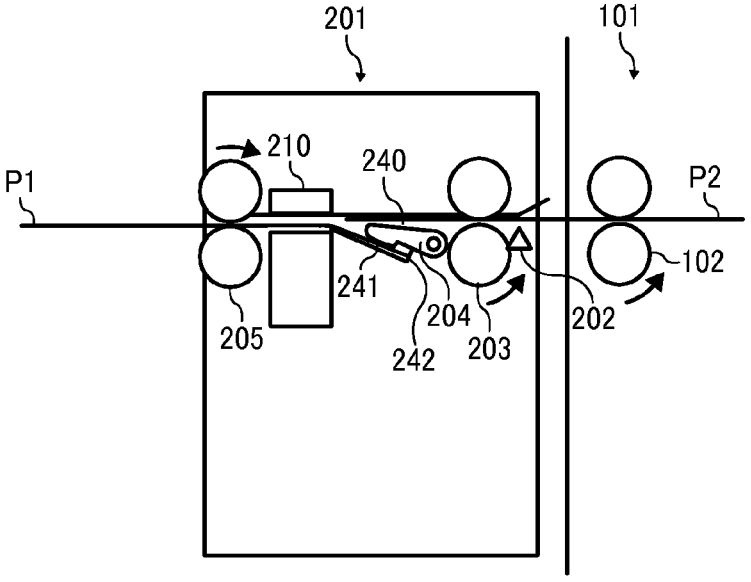

FIGS. 13A and 13B illustrate a state in which the second sheet P2 is received in the sheet processing apparatus 201. After the state shown in FIGS. 12A and 12B, as the subsequent sheets P3 through Pn are transported from the image forming apparatus 101, operations shown in FIGS. 10A through 11B are executed to sequentially transport the sheets P to a predetermined position and align the sheets P there. Thus, a sheet bundle 272 is stacked in the conveyance channel 240.

Figure 14A:
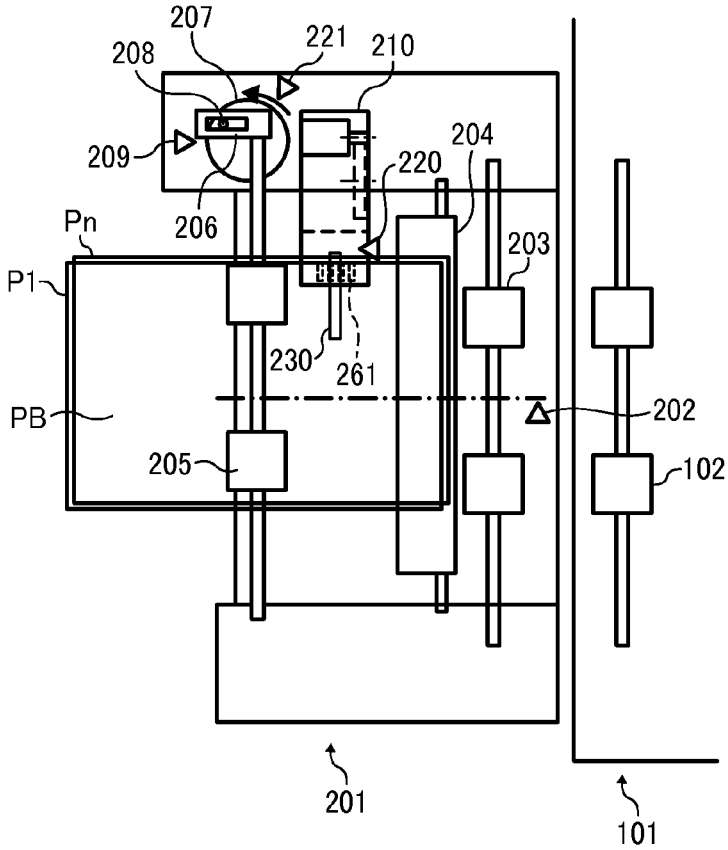
FIGS. 14A and 14B illustrate a state in which a last sheet is aligned with the preceding sheets, forming a sheet bundle.
Figure 14B:
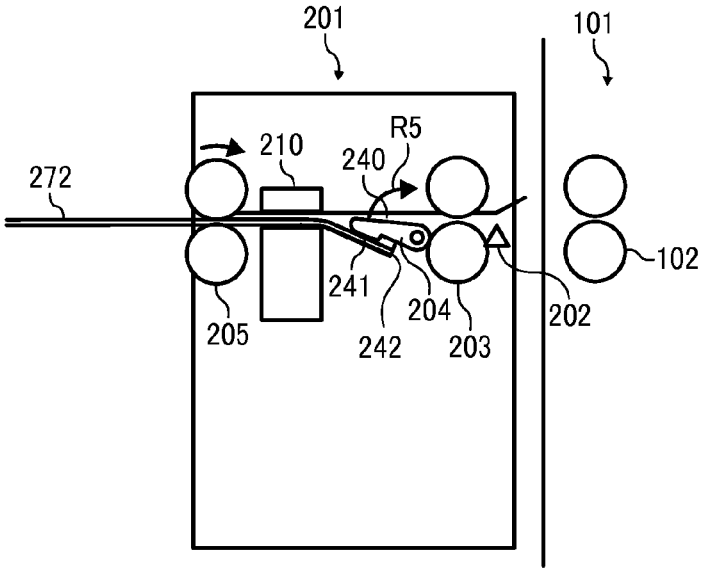

FIGS. 14A and 14B illustrate a state in which the last sheet Pn is aligned with the preceding sheets P, forming the sheet bundle 272. After the last sheet Pn is aligned and the sheet bundle 272 is formed, the discharge rollers 205 are rotated a predetermined amount in the sheet conveyance direction. This operation can eliminate the slackening of the sheet P caused when the trailing end of the sheet P contacts the contact face 242. Subsequently, the branch pawl 204 rotates in the direction indicated by arrow R5 to disengage the pressing face 204*c* from the bifurcation channel 241, thereby canceling the pressure applied to the sheet bundle 272. Thus, the sheet bundle 272 is released from the branch pawl 204 and can be transported by the discharge rollers 205.

Figure 15A:
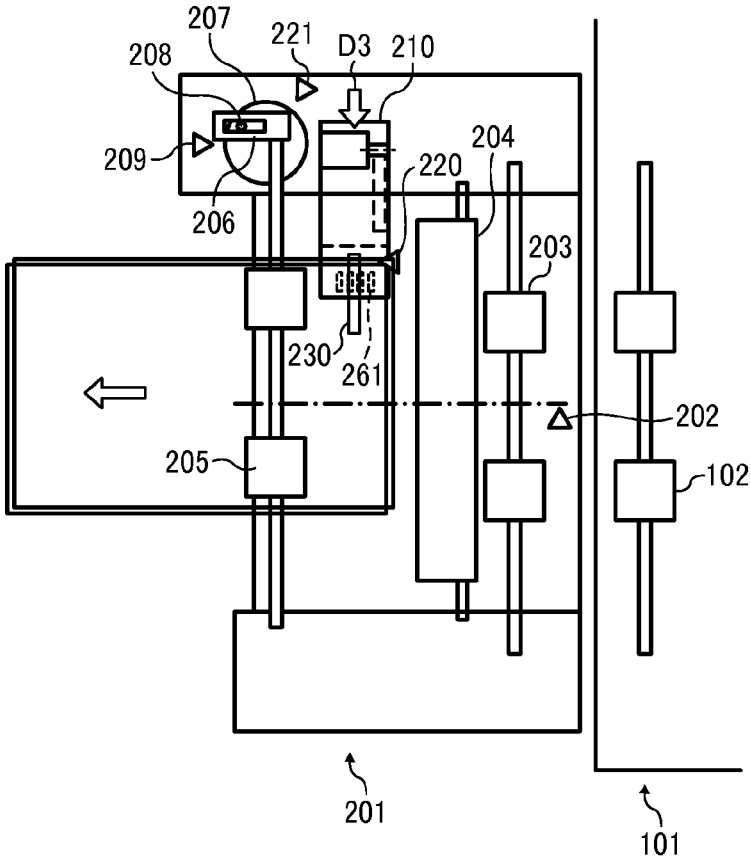
FIGS. 15A and 15B illustrate binding operation subsequent to the state shown in FIGS. 14A and 14B.
Figure 15B:
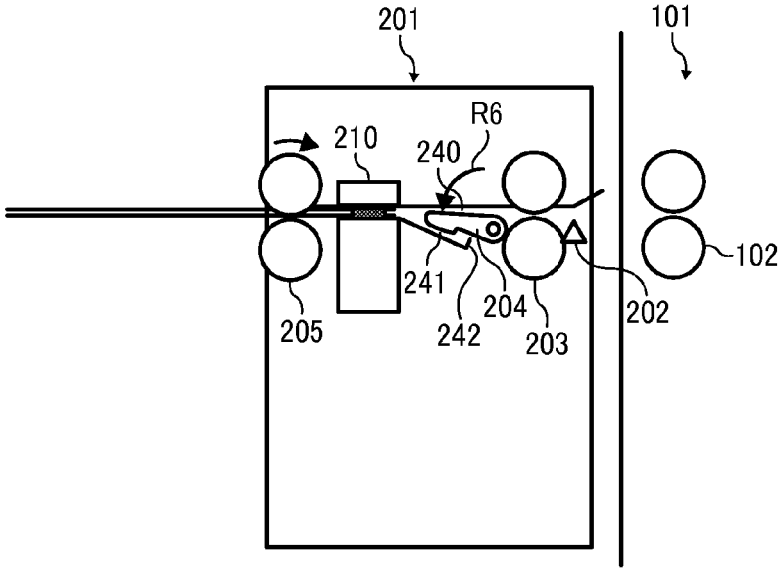

FIGS. 15A and 15B illustrate binding operation. After the state shown in FIGS. 14A and 14B, the discharge rollers 205 rotate in the sheet conveyance direction and stop when a binding position in the sheet bundle 272 reaches the pair of tooth forms 261 of the binding device 210. Thus, the binding position in the sheet bundle 272 is aligned with the position of the tooth forms 261 in the sheet conveyance direction. Additionally, the binding device 210 is moved in the direction indicated by arrow D3 shown in FIG. 15A (hereinafter "direction D3 or sheet width direction"), perpendicular to the sheet conveyance direction, until the pair of tooth forms 261 is aligned with the binding position in the sheet bundle 272 in the sheet width direction.

Accordingly, the binding position in the sheet bundle 272 is aligned with the tooth forms 261 in the sheet conveyance direction as well as the width direction. Then, the branch pawl 204 rotates in the direction indicated by arrow R6 shown in FIG. 15B and returns to the state for receiving the subsequent sheet P. Subsequently, the drive motor 265 is turned on, and the pair of tooth forms 261 squeezes the sheet bundle 272, thereby binding the sheet bundle 272 (i.e., clamp binding). It is to be noted that, although the description above concerns the binding device 210 employing clamp binding, other type of binding, for example, half blanking, lancing, and bending and inserting can be used instead.

Figure 16A:
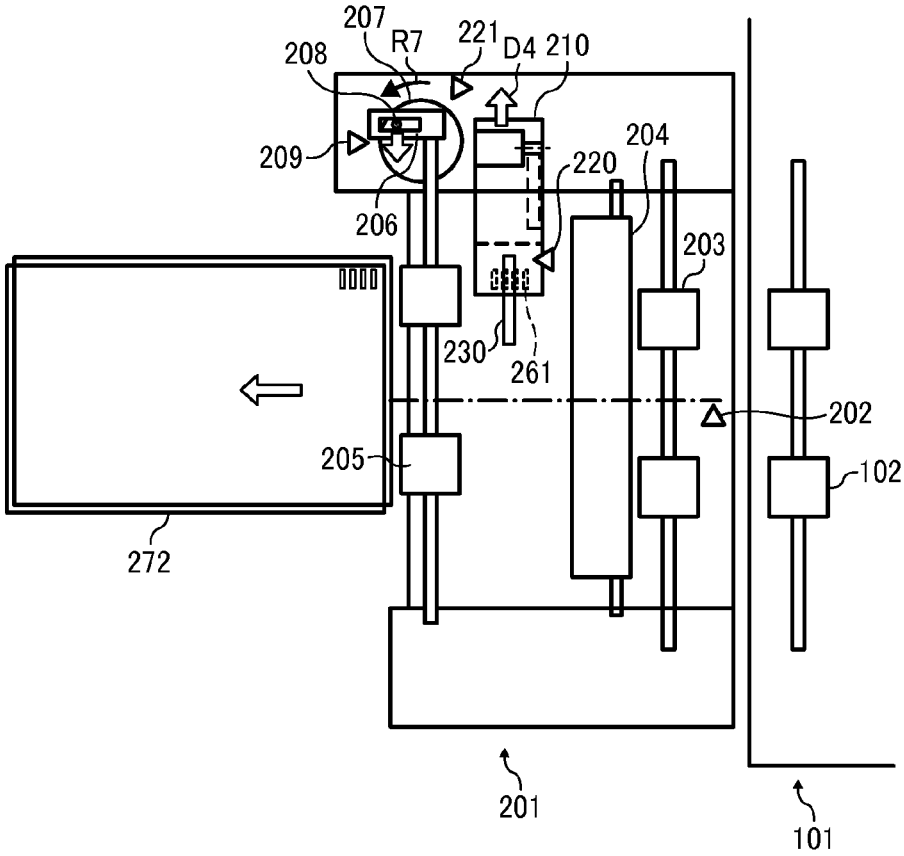
FIGS. 16A and 16B illustrate a state in which the sheet bundle is discharged.
Figure 16B:
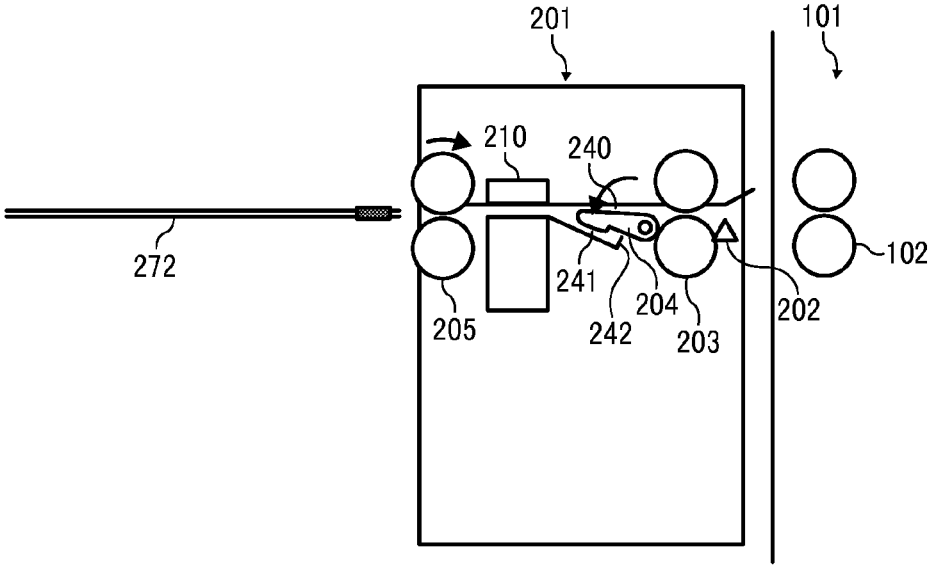

FIGS. 16A and 16B illustrate a state in which the sheet bundle 272 is discharged. After the sheet bundle 272 is bound together as shown in FIGS. 15A and 15B, the discharge rollers 205 rotate to discharge the sheet bundle 272. After the sheet bundle 272 is discharged, the shift cam 207 rotates in the direction indicated by arrow R7 shown in FIG. 16A to the home position (shown in FIG. 8A). In parallel to this operation, the binding device 210 moves in the direction indicated by arrow D4 shown in FIG. 16A to the home position shown in FIGS. 8A and 8B. Thus, alignment and binding of a single copy of sheets (a bundle of sheets) is completed. The operations shown in FIGS. 8A through 16B are repeated for binding subsequent copies, if any.

First Embodiment

Next, a description is given below of a first embodiment in which clamp binding is made at a corner of the sheet bundle such that the longitudinal direction of a clamping mark 281 (shown in FIG. 22) is perpendicular to the sheet width direction (perpendicular to the sheet conveyance direction).

In this case, the discharge rollers 205 are rotated in the sheet conveyance direction from the state shown in FIGS. 14A and 14B to transport the sheet bundle 272 until the pair of tooth forms 261 is positioned at the claimed position in a corner area of the sheet bundle 272.

Figure 17A:
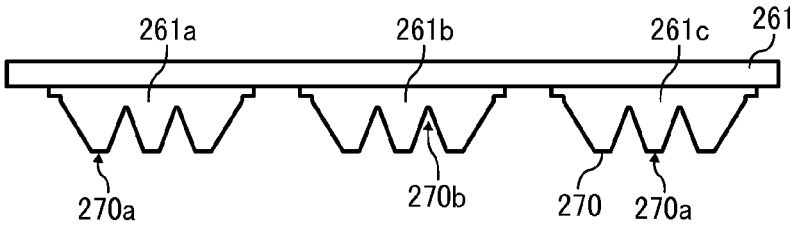
FIGS. 17A and 17B illustrate a configuration of a pair of tooth forms of the binding device according to an embodiment.
Figure 17B:
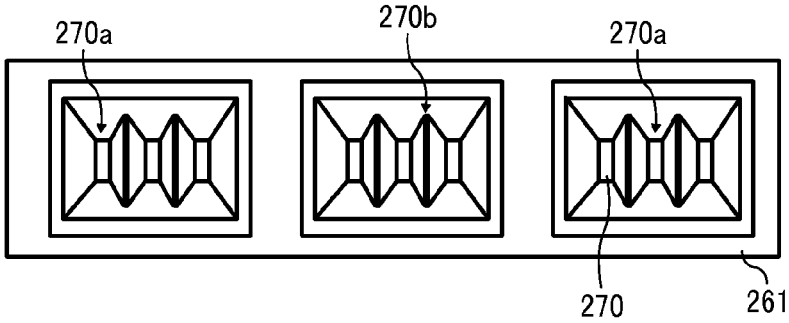

A configuration of the tooth forms 261 is described below with reference to FIGS. 17A and 17B. FIGS. 17A and 17B are a front view and a plan view of one (e.g., the upper one) of the two tooth forms 261, respectively.

The pair of tooth forms 261 serves as a clamping unit. Each tooth form 261 includes first, second, and third tooth units 261*a*, 261*b*, and 261*c*, each of which includes projections 270*a* and recesses 270*b*.

It is to be noted that, although not shown in FIGS. 17A and 17B, the other tooth form 261 (i.e., the lower tooth form 261) also includes three tooth units each including projections 270*a* and recesses 270*b*, designed to engage the tooth units 261*a*, 261*b*, and 261*c* shown in FIGS. 17A and 17B, respectively. In clamp binding, the projection 270*a* of the upper tooth form 261 engages the recess 270*b* of the lower tooth form 261 with the recess 270*b* of the upper tooth form 261 mating with the projection 270*a* of the lower tooth form 261.

In the configuration shown in FIGS. 17A and 17B, each tooth unit of the lower tooth form 261 has three recesses 270*b* to fit the projections 270*a* of the tooth units 261*a*, 261*b*, 261*c* of the upper tooth unit 261 via the sheet bundle 272. Three clamping marks 280 (shown in FIG. 18) are created with each of the first through third tooth units 261*a*, 261*b*, and 261*c*. Thus, nine clamping marks 280 are created in total. It is to be noted that, in FIG. 17B, reference number 270 represents a clamping face (end face) of the projection 270*a* that makes the clamping mark 280.

Figure 18:
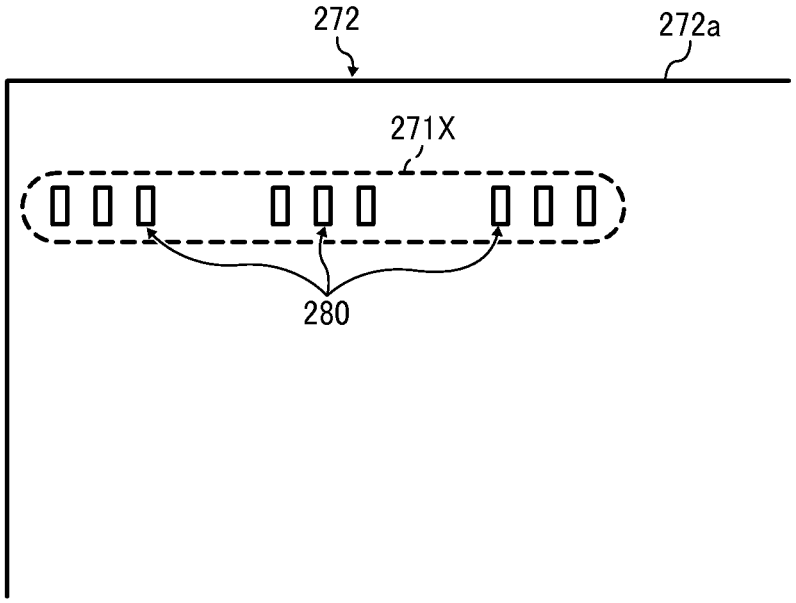
FIG. 18 is a partial front view of a sheet bundle bound by clamp binding according to a comparative example.

FIG. 18 is a partial front view of a sheet bundle 272 bound according to the comparative example.

Figure 22:
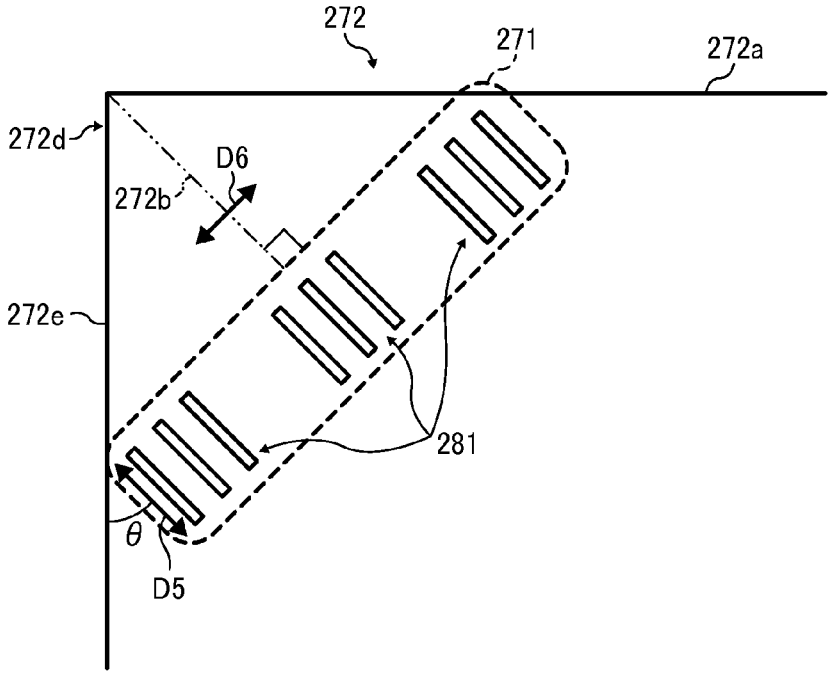
FIG. 22 illustrates clamping marks in corner binding according to an embodiment, arranged perpendicularly to a diagonal line of the sheets.

As shown in FIG. 18, the upper left corner of the sheet bundle 272 is bound by clamp binding. In FIG. 18, reference character 272*a* represents an upper end of the sheet bundle 272. In FIG. 18, reference character 271X represents an area clamped or squeezed in the comparative example (hereinafter "clamped area 271X"). FIG. 22 illustrates a clamped area 271 including clamping marks 281 according to the present embodiment. When the binding device 210 shown in FIGS. 17A and 17B is used, the sheet bundle 272 is bound by nine clamping marks 281. Specifically, each of the tooth units 261*a*, 261*b*, and 261*c* creates a single block of three clamping marks 281, and the tooth forms 261 create the nine clamping marks 281 in total. In other words, clamp binding is made by the nine clamping faces 270 creating the respective clamping marks 281.

Descriptions are given of undesirable easiness of peeling of the sheet from the sheet bundle when the sheet is turned.

In clamp binding, binding strength may be enhanced to a certain degree by increasing the strength of a squeezing mechanism (pressing force of tooth forms). This approach, however, requires a greater force to drive the binding device, and accordingly a motor and the squeezing mechanism increases in size or complexity, resulting in increases in size and cost of the sheet processing apparatus. Additionally, even if the binding strength is thus increased, it is lower than the strength attained by binding using metal staples.

Further, although the number or arrangement of tooth of the tooth forms may be changed to increase the binding strength, additional mechanisms for that is required, making the binding mechanism more complicated. Since the size and cost of the complicated binding mechanism are higher, it is not suitable for low-cost sheet processing apparatuses. Additionally, increasing the binding strength does not means that the sheet can be made less separable from the sheet bundle clamped thereby. That is, the strong binding strength does not necessarily attain less-separable clamp binding.

In view of the foregoing, an aim of the present embodiment is to provide clamp binding that is less separable when the sheet is turned without changing the mechanism of clamp binding.

Descriptions are given below of the relation between the direction of turning sheets and undesired easiness in separation of the sheet of the sheet bundle 272 bound by clamp binding.

The nine clamping faces 270 are arranged parallel to each other in the configuration shown in FIGS. 17A and 17B and designed to form nine clamping marks 281 as the tooth forms 261 squeeze the sheet bundle 272. In the comparative example shown in FIG. 18, nine clamping marks 280 are created by similar nine clamping faces.

Figure 19:
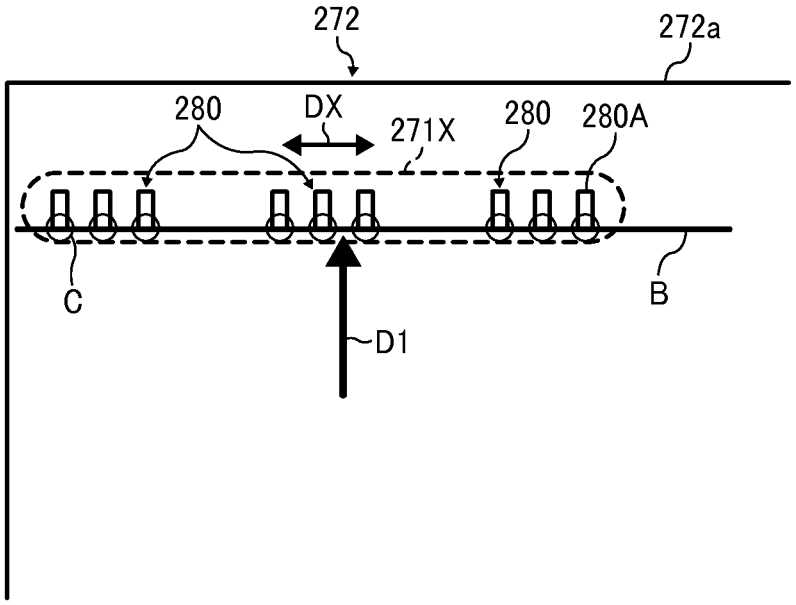
FIG. 19 illustrates a state when a sheet of the sheet bundle is turned perpendicularly to a direction in which clamping marks are arranged in the comparative example shown in FIG. 18.
Figure 20:
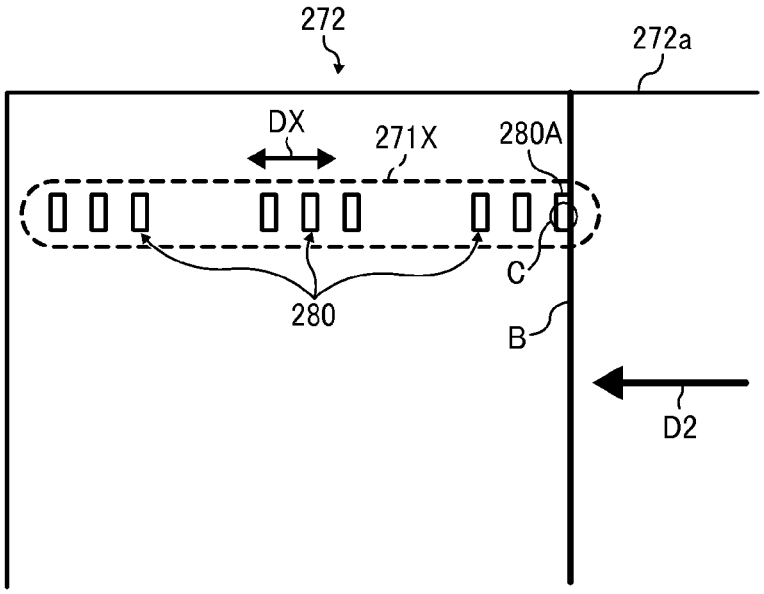
FIG. 20 illustrates a state when the sheet is turned parallel to the arrangement direction of clamping marks in the comparative example shown in FIG. 18.
Figure 21:
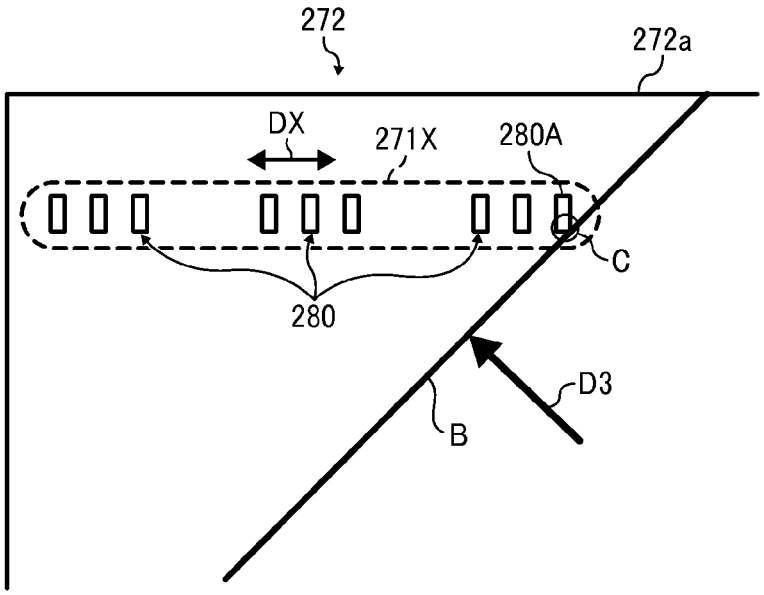
FIG. 21 illustrates a state when the sheet is turned obliquely to the arrangement direction of clamping marks in the comparative example shown in FIG. 18.

FIGS. 19, 20, and 21 illustrate the direction in which the sheet of the sheet bundle is turned (hereinafter "sheet turning direction") and positions at which the sheet is peeled from the clamping marks 280. In FIGS. 19, 20, and 21, reference character B represent a peeling position in the sheet turning direction, at which the sheet is peeled from the sheet bundle 272, and reference character C represents a contact (i.e., a contact point) between the clamping mark 280 and the peeled sheet at the peeling position B. Specifically, the contact C means the position where the sheet is peeled off from the sheet bundle 272, and force to peel the sheet acts on the contact C.

FIG. 19 illustrates a state when the sheet is turned in the direction indicated by arrow D1 (hereinafter simply "direction D1") perpendicular to the arrangement direction (indicated by arrow DX) of the clamping marks 280 in a clamped area 271X, that is, the sheet is turned parallel to the longitudinal direction of each clamping mark 280. In this case, the peeling position B (i.e., line B connecting the peeled positions) parallels to the arrangement of the clamping marks 280, and the nine contacts C are present on the line B. Accordingly, the force of peeling can be dispersed, thus reducing the strength of force acting on each clamping mark 280. This configuration makes the sheet less separable from the sheet bundle 272.

FIG. 20 illustrates a state when the sheet is turned in the direction D2 parallel to the direction indicated by arrow DX in which the clamping marks 280 are arranged (hereinafter "arrangement direction DX") in the clamped area 271X, that is, the sheet is turned perpendicular to the longitudinal direction of the clamped area 271X. In this case, the peeling position B1 parallels to the direction of each clamping mark 280 and perpendicular to the longitudinal direction of the clamping marks 280. As shown in FIG. 20, the sheet has the contact C with only the first clamping mark 280 from the right in FIG. 20. Accordingly, the contact C has a length identical to the longitudinal length of the first clamping mark 280 from the right in FIG. 20, which is significantly small relative to the longitudinal length of the entire clamped area 271X. The peeling force is applied to only one of the nine clamping marks 280, making the sheet more separable from the sheet bundle 272.

FIG. 21 illustrates a state when the sheet is turned in the direction D3 oblique (about 45 degrees) to the arrangement direction DX of the clamping marks 280 in the clamped area 271X, that is, he sheet is turned at about 45 degrees to the longitudinal direction of the clamped area 271X. In this case, the peeling position B2 is inclined to the arrangement direction DX of the clamping marks 280. As shown in FIG. 21, the contact C is present only in the first clamping mark 280 from the right in FIG. 21. Accordingly, the peeling force is applied to only the first clamping mark 280 from the right, and the sheet can be separated easily similarly to the case shown in FIG. 20. Moreover, the sheet is more separable in the case shown in FIG. 21 than the case shown in FIG. 20 because the length of the contact C is about √2 of the maximum width of the clamping mark 280.

Thus, in the comparative examples, when the clamped area 271X parallels to the upper end 272*a* of the sheet bundle 272, easiness of peeling of sheets can significantly depend on the direction in which the sheet is turned or peeled). Additionally, in the cases shown in FIGS. 20 and 21, increasing the number of the clamping faces 270 does not alleviate easiness in peeling because the peeling force is localized on a single clamping mark 280. To reduce the easiness in peeling in such arrangement, the strength (i.e., pressure) of clamping may be increased. Increasing the strength, however, makes the binding device 210 more complicated or bulkier.

Second Embodiment

A description is made below of a second embodiment in which clamp binding is made in a corner area 272*d* at a corner such that the longitudinal direction indicated by arrow D5 (hereinafter "longitudinal direction D5") of the clamping mark 281 is oblique to the sheet width direction.

In the present embodiment, the pair of tooth forms 261 (in particular, the clamping faces 270) of the binding device 210 is arranged such that the an angle θ between a side 272*e* of the corner area 272*d* and the longitudinal direction D5 of each clamping mark 281 is within a range from about 30 degrees to 60 degrees, and that the arrangement direction arrow D6 of the clamping marks 281 is perpendicular to a diagonal line 272*b* of the corner area 272*d*. It is to be noted that the binding device 210 may include both a pair of tooth forms 261 for vertical binding and a pair of tooth forms 261 for oblique binding.

Figure 23:
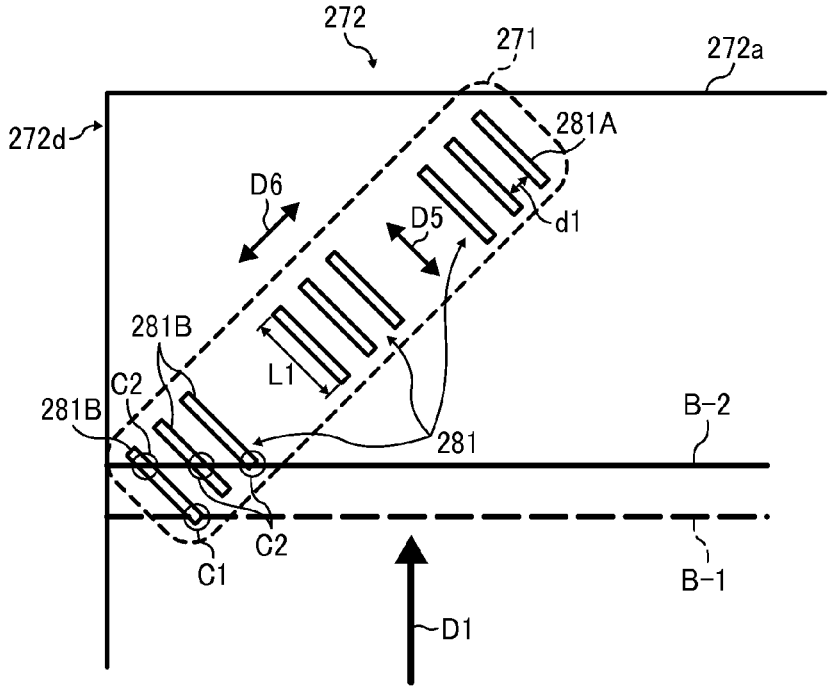
FIG. 23 illustrates a state in which the sheet is turned perpendicularly to an upper end of the sheet bundle with the clamping mark arrangement shown in FIG. 22.
Figure 24:
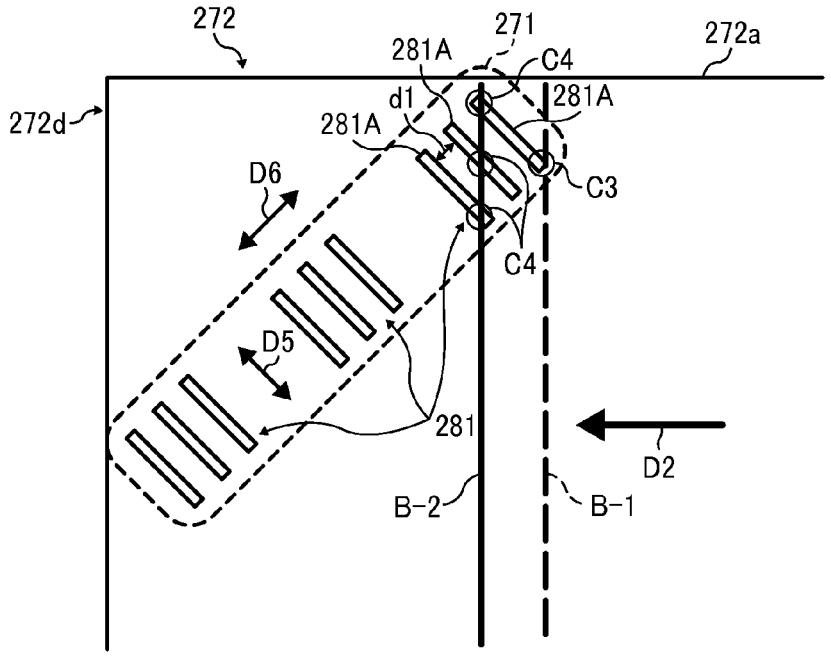
FIG. 24 illustrates a state in which the sheet is turned parallel to the upper end of the sheet bundle with the clamping mark arrangement shown in FIG. 22.
Figure 25:
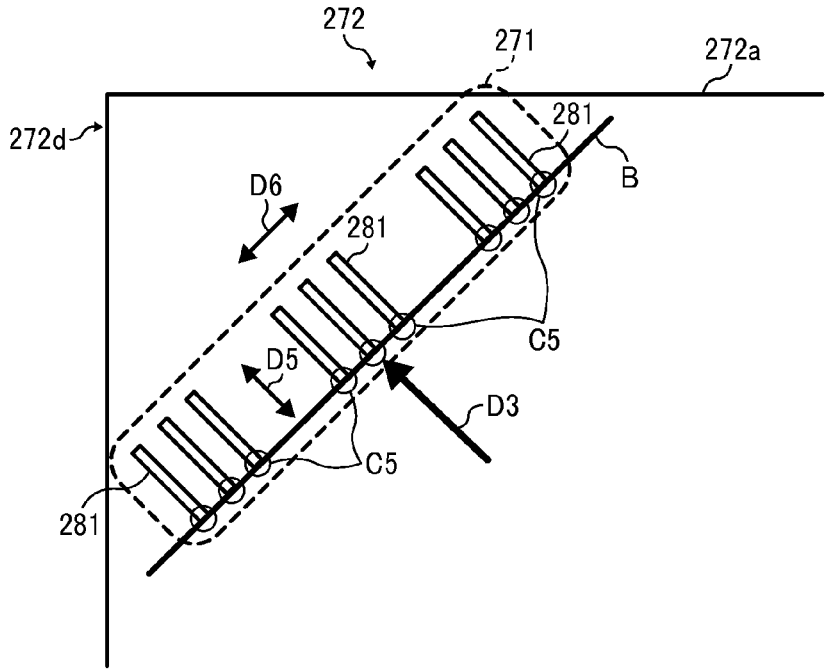
FIG. 25 illustrates a state in which the sheet is turned obliquely to the upper end of the sheet bundle with the clamping mark arrangement shown in FIG. 22.

Additionally, in the present embodiment, a longitudinal length L1 of a single clamping mark 281 is designed such that there are at least two contacts C with the clamping marks 281 at the peeling position B in each of the following three cases:

a first case shown in FIG. 23, in which the sheet is turned in the direction D1 perpendicular to the upper end 272*a* of the sheet bundle 272;

a second case shown in FIG. 24, in which the sheet is turned in the direction D2 parallel to the upper end 272*a* of the sheet bundle 272; and a third case shown in FIG. 25, in which the sheet is turned in the direction D3, obliquely to the upper end 272*a* of the sheet bundle 272.

It is to be noted that, in FIGS. 23 and 24, as the sheet is turned, the sheet initially contacts at least one of the clamping marks 281 at a position B-1 in the sheet turning direction (hereinafter "single contact position B-1").

In the first case shown in FIG. 23, initially the turned sheet contacts only the first lamping mark 281 (i.e., contact C1) from the left in FIG. 23 at the single contact position B-1, and the peeling force is localized thereto. In the first case shown in FIG. 23, initially the turned sheet contacts only the first lamping mark 281 from the left in FIG. 23 at the single contact position B-1, and the peeling force is localized thereto. When the sheet is turned further, the sheet would be separated from the sheet bundle 272.

Then, when the sheet is turned to a position B-2, there are three contacts C2 between the peeling position B and the clamping marks 281, one contact C2 in each of the three clamping marks 281B from the left in FIG. 23. Thus, the peeling force can be divided into three. Therefore, undesired easiness of peeling can be alleviated to one third of that in the case shown in FIGS. 20 and 21.

Therefore, the length L1 of the clamping mark 281 is determined to secure at least two contacts C at the peeling position B in each of the three cases shown in FIGS. 23 to 25, and the length L1 depends on a distance d1 between adjacent two clamping marks 281. That is, when the distance d1 is relatively short, three contacts C can be secured even if the length L1 of the clamping mark 281 is relatively short. Accordingly, it is preferable that the length L1 of the clamping mark 281 and the distance d1 between the adjacent clamping marks 281 be set according to relations obtained through a preliminary experiment for various combinations while the shape and the size of the tooth forms 261 are changed.

Referring to FIG. 24, as the sheet is turned in the direction D2 parallel to the upper end 272*a*, initially the turned sheet has only a single contact C3 with the first clamping mark 281 from the right in FIG. 24 at the single contact position B-1, and the peeling force is localized thereto. If the sheet is turned further in this state, the sheet would be separated from the sheet bundle 272. Then, when the sheet is turned to a position B-2, the sheet has three contacts C4 with the clamping marks 281, a single contact in each of the three clamping marks 281A from the right in FIG. 24. Thus, the peeling force can be divided into three. Therefore, compared with the configurations shown in FIGS. 20 and 21, the resistance against peeling can be triplicate.

In the third case shown in FIG. 25, the sheet is turned in the direction D3, perpendicular to the direction indicated by arrow D6 in which the clamping marks 281 are arranged (parallel to the longitudinal direction of the clamped area 271 and hereinafter "arrangement direction D6"). As the sheet is turned, initially the sheet has contacts C5 with the clamping marks 281 at the peeling position B. The contacts C5 are positioned at the end of each clamping mark 281 on the side from which the sheet is turned (i.e., sheet turning side), and the sheet contacts the nine clamping marks 281 simultaneously or almost simultaneously. Then, the sheet is peeled sequentially along the longitudinal direction of the clamping marks 281. In other words, the nine positions where the sheet is bound to the sheet bundle 272 are sequentially released. Accordingly, the peeling force can be divided into nine, making the peeling force exerting on each clamping mark 281 smaller. This state is similar to the state shown in FIG. 19 when only the direction of the clamping mark 281 and the sheet turning direction are considered.

As shown in FIGS. 23 through 25, when clamp binding is executed such that the longitudinal direction D5 of each clamping mark 281 forms an angle within a range from 30 to 60 degrees with one side 272*e* of the corner area 272*d* of the sheet bundle 272 on the binding side, the resistance to peeling can be triplicate compared with the cases shown in FIGS. 20 and 21 although the resistivity in FIG. 24 is similar to that in FIG. 19. With this configuration, the resistance against peeling the sheet from the sheet bundle 272 can be enhanced by changing the direction of binding and the length of the clamping faces 270, without increasing complexity, size, or binding strength of the binding device 210.

Third Embodiment

Next, a description is given of a third embodiment in which clamp binding is made in a center area in the width direction of the sheet bundle such that the longitudinal direction D5 of the clamping mark 281 is perpendicular to the sheet width direction.

In this case, the discharge rollers 205 are rotated in the sheet conveyance direction from the state shown in FIGS. 14A and 14B to transport the sheet bundle 272 until the pair of tooth forms 261 is positioned in a center area of the sheet bundle 272 in the sheet width direction. Further, the binding device 210 is moved in the sheet width direction as indicated by arrow D3 shown in FIG. 15A.

Figure 26:
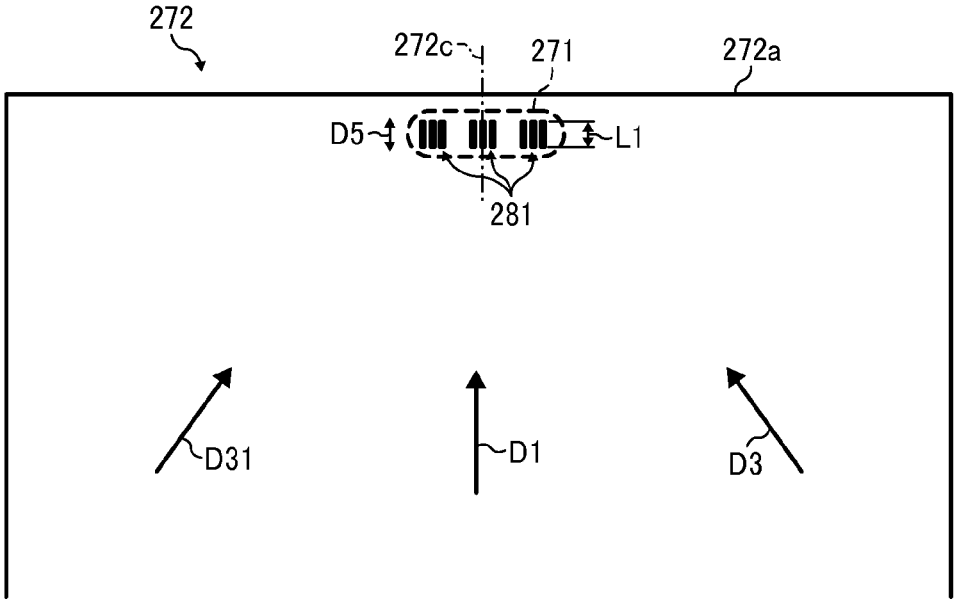
FIG. 26 illustrates a front view of the sheet bundle bound at a center position by clamp binding according to an embodiment.

FIG. 26 illustrates a front view of a main part of the sheet bundle 272 bound by clamp binding at a center position.

In center binding according to the present embodiment, the above-described clamped area 271 including the multiple clamping marks 281 is provided at a single position at a center in an end portion (adjacent to the upper end 272*a* in the configuration shown in FIG. 26) of the sheet bundle 272. The tooth forms 261 shown in FIGS. 17A and 17B or similar can be used also in this case.

The binding marks 281 shown in FIG. 26 is different from the comparative example shown in FIG. 18 in that the length L1 of the clamping mark 281 is longer and that the clamped area 271 is positioned at a center position in the width direction not the corner area 272*d* (shown in FIGS. 23 to 25) of the sheet bundle 272.

When the clamped area 271 bound by the tooth forms 261 is positioned at the center position in the sheet width direction and in the end portion in the longitudinal direction, usually users turn sheets in the direction D1 perpendicular to the upper end 272*a* or oblique (direction D3 or D31) to the upper end 272*a*. It can be deemed that turning sheets in parallel to the upper end 272*a* as indicated by arrow D2 shown in FIG. 24 is rare when the sheets are bound at the center position. Therefore, in center binding according to the present embodiment, the longitudinal length L1 of the clamping mark 281 is set such that multiple contacts C between the sheet turned and the clamping marks 281 are present when the sheet is turned in those directions.

Specifically, the effects similar to those of corner binding described with reference to FIGS. 23 through 25 can be attained when the relations between the direction of the clamped area 271 and the direction in which the sheet is turned is identical or similar to that in the configuration shown in FIG. 23, 24, or 25. Therefore, in the present embodiment, the clamping marks 281 shown in FIGS. 23 through 25 are arranged at the center position of the sheet bundle 272 in the sheet width direction and the end portion in the sheet conveyance direction such that the longitudinal direction D5 of each clamping mark 281 is perpendicular to the upper end 272*a* of the sheet bundle 272. With this arrangement, when the sheet is turned obliquely in the direction D3 or D31, the relation between the arrangement direction of the clamping marks 281 and the sheet turning direction are identical or similar to that shown in FIG. 23 or 24. Additionally, when the sheet is turned from below (i.e., in the direction D1), the relation between the sheet turning direction and the direction of the clamping mark 281 or the clamped area 271 is identical or similar to that shown in FIG. 25. Accordingly, three contacts (C2 in FIG. 23 or C4 in FIG. 24) can be present when the sheet is turned obliquely, and nine contacts (C5 shown in FIG. 25) can be present when the sheet is turned from below. Thus, the peeling force can be divided, making the sheet less separable from the sheet bundle 272.

It is to be noted that, although a single clamped area 271 is disposed symmetrically to a centerline 272*c* in the sheet width direction in the configuration shown in FIG. 26, the clamped area 271 is not necessarily symmetrical to the centerline 272*c* as long as the clamped area 271 overlaps the centerline 272*c*. Except the differences described above, the configuration of the present embodiment and effects attained thereby are similar to the above-described embodiment.

Fourth Embodiment

Next, a description is given of a fourth embodiment in which clamp binding is made at two positions in a center area in the sheet width direction. The longitudinal direction D5 of the clamping mark 281 in this case is perpendicular to the sheet width direction.

In this case, the discharge rollers 205 are rotated in the sheet conveyance direction from the state shown in FIGS. 14A and 14B to transport the sheet bundle 272 until the pair of tooth forms 261 is positioned at the clamped position in the sheet conveyance direction. When the tooth form 261 shown in FIGS. 17A and 17B is used, the binding device 210 is moved in the sheet width direction to one of two clamped positions of the sheet bundle 272 and then binds that position, after which the binding device 210 is moved to the other clamped position. Alternatively, a pair of tooth forms 261 capable of binding at two positions at a single binding operation may be used.

Figure 27:
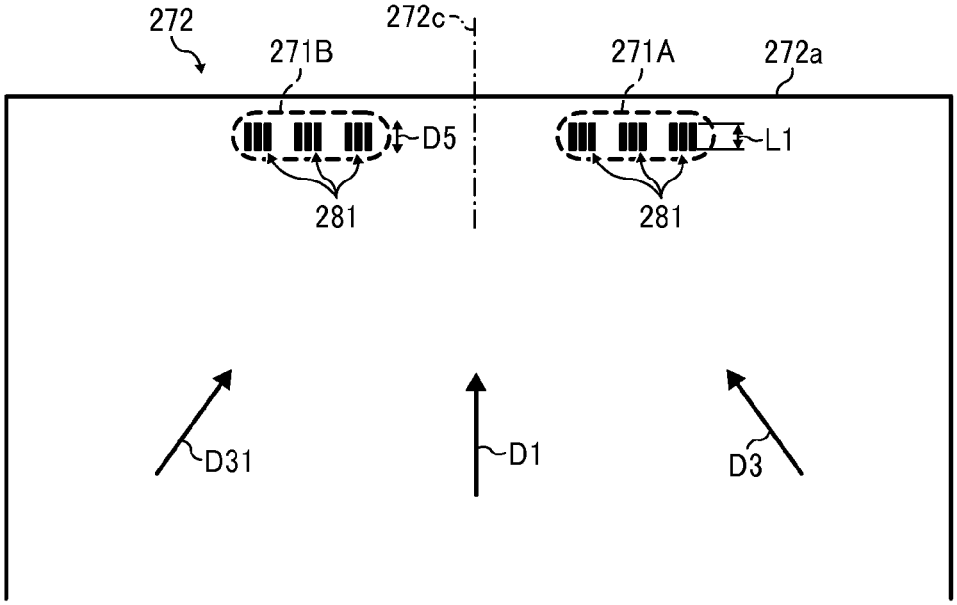
FIG. 27 illustrates a front view of the sheet bundle bound at a center position by clamp binding according to another embodiment.

FIG. 27 illustrates a front view of a main part of the sheet bundle 272 bound by two-position clamp binding in a center area in the sheet width direction.

In two-position binding in a center area according to the present embodiment, two clamped areas 271, namely, first and second clamped areas 271A and 271B, are provided symmetrically to the centerline 272*c* in the center area in an end portion (adjacent to the upper end 272*a* in FIG. 27) of the sheet bundle 272. The tooth forms 261 shown in FIGS. 17A and 17B or similar can be used also in this case.

The first and second clamped areas 271A and 271B in the present embodiment are similar to the clamped area 271 shown in FIG. 26. Other configurations are similar to those of the embodiment shown in FIG. 26. Specifically, the first and second clamped areas 271A and 271B are formed symmetrically to the centerline 272*c* in the end portion of the sheet bundle 272. Similarly to FIGS. 23 through 25, the longitudinal direction D5 of each clamping mark 281 is perpendicular to the upper end 272*a* of the sheet bundle 272.

With this arrangement, similarly to the embodiment shown in FIG. 26, when the sheet is turned obliquely in the direction D3 or D31, the relation between the arrangement direction of the clamping marks 281 and the sheet turning direction are identical or similar to that shown in FIG. 23 or 24. Additionally, when the sheet is turned from below (i.e., in the direction D1), the relation between the sheet turning direction and the direction of the clamping mark 281 or the clamped area 271 is identical or similar to that shown in FIG. 25. Accordingly, three contacts (C2 in FIG. 23 or C4 in FIG. 24) can be present when the sheet is turned obliquely, and 18 contacts (C5 shown in FIG. 25) can be present when the sheet is turned from below. Thus, the peeling force can be divided, making the sheet less separable from the sheet bundle 272.

It is to be noted that, although the first and second clamped areas 271A and 271B are disposed symmetrically to the centerline 272*c* in the sheet width direction in the configuration shown in FIG. 27, the first and second clamped areas 271A and 271B are not necessarily symmetrical. Except the differences described above, the configuration of the embodiment shown in FIG. 27 and effects attained thereby are similar to those of the above-described embodiment shown in FIGS. 22 though 25 or that shown in FIG. 26.

As described above, the above-described embodiments can attain the following effects.

1) A sheet processing apparatus includes the bifurcation channel 241 serving as a stacking channel to stack multiple sheets transported, and a binding device 210 that clamps and binds together the sheets into a sheet bundle 272 using a tooth form 261 including the multiple clamping faces 270 serving as multiple clamping portions. When the binding device 210 binds a corner area of the sheet bundle 272, the longitudinal direction of each of the clamping marks 281 created by the clamping faces 270 of the biding device 210 forms an angle θ within a range from about 30 to 60 degrees.

Accordingly, when a sheet of the sheet bundle 272 bound by the binding device 210 is turned, the turned sheet can have multiple contacts (C2, C4, and C5) with the clamping marks 281. Consequently, the peeling force can be divided, weakening peeling force exerted on a single clamping mark 281. Without changing the mechanism of clamp binding, this configuration can attain clamp binding that is less separable when the sheet is turned.

2) In a sheet processing apparatus that includes a stacking channel, such as the bifurcation channel 241, to stack multiple sheets transported, and a binding device such as the binding device 210 that clamps and binds together the sheets into a sheet bundle using a tooth form 261 including multiple clamping portions (such as the clamping faces 270), when the binding device 210 binds the sheets in a center portion along one side (binding side) of the sheet bundle, the longitudinal direction of each of the clamping marks 281 created by the respective clamping faces 270 of the biding device 210 is substantially perpendicular to the biding side of the sheet bundle 272.

Accordingly, when the user turns the sheet in a typical direction, the turned sheet can have multiple contacts with the clamping marks 281. Consequently, the peeling force can be divided, and less-separable clamp binding can be attained.

3) The multiple clamping faces 270 are arranged with their longitudinal ends aligned with each other. Thus, when the sheet is turned in a direction parallel to the longitudinal direction of each clamping mark 281, the sheet can contact all of the multiple clamping marks 281 simultaneously or almost simultaneously. Additionally, the multiple clamping faces 270 are arranged such that the sheet can have two or more contacts with the clamping marks 281 when the sheet is turned in a direction at an angle with the longitudinal direction of the clamping mark 281. Accordingly, compared with conventional clamp binding, resistivity against peeling can be at least doubled.

4) Since the longitudinal direction of the projection 270*a* of the binding device 210 is sufficient for the turned sheet to have multiple contacts with the clamping marks 281, the peeling force can be divided even when the sheet is turned in a direction inclined to the longitudinal direction of the clamping mark 281.

5) Since the distance d1 between two adjacent projections 270*a* (clamping faces 270 in particular) is sufficient for the turned sheet to have multiple contacts with the clamping marks 281 in relation to the above-described length, the peeling force can be divided even when the sheet is turned in a direction inclined to the longitudinal direction of the clamping mark 281.

6) Since the binding device 210 includes multiple sets, for example, three sets, of tooth units 261 each having multiple linear projections 270*a*, the turned sheet can have multiple contacts with the clamping marks 281 even when the sheet is turned obliquely.

7) The tooth unit 261 includes the projections 270*a* and the recesses 270*b* designed to engage the projections 270*a*, and the sheets are clamped between the projections 270*a* and the recesses 270*b*, thereby creating the clamping marks 281. Accordingly, the direction of the clamping marks 281 can be determined by the direction of the tooth units 261.

By designing the direction of binding by the clamping faces 270 of the binding device 210 according to the sheet turning direction, the practical strength of binding can be enhanced without increasing the strength of clamping (attained by changing the mechanism or clamping torque). That is, the binding direction (i.e., arrangement direction of the multiple clamping faces 270) is determined according to the sheet turning direction, thereby attaining less-separable clamp binding without changing the mechanical configuration of clamp binding.

8) In the image forming system that includes the sheet processing apparatus 201 and the image forming apparatus 101, a housing-internal discharge type clamp binding device capable of less-separable clamp binding can be provided at a lower cost.

According to the embodiments of the present invention, clamp binding that is less separable when the sheet is turned can be attained without changing the mechanism of clamp binding.

It is to be noted that the present invention is not limited to the specific embodiments described above, and numerous additional modifications and variations are possible in light of the above teachings. It is therefore to be understood that, the disclosure of this patent specification may be practiced otherwise than as specifically described herein, and such variations, modifications, alternatives are within the technical scope of the appended claims.

What is claimed is:

1. A sheet processing apparatus comprising:

a stacking channel configured to stack multiple sheets into a sheet bundle; and a binding device configured to bind together the sheet bundle, the binding device including multiple clamping portions to clamp the sheet bundle to create multiple clamping marks on the sheet bundle, wherein, when the binding device binds a corner area of the sheet bundle, a longitudinal direction of each of the multiple clamping marks forms an angle within a range from 30 degrees to 60 degrees with a side of the corner area of the sheet bundle, and the multiple clamping portions of the binding device are arranged such that a longitudinal direction of each clamping portion forms the angle within the range from 30 degrees to 60 degrees with the side of the corner area of the sheet bundle.

2. The sheet processing apparatus according to claim 1, wherein longitudinal ends of the multiple clamping portions are aligned with each other, and when the sheet of the sheet bundle is turned in a direction parallel to the longitudinal direction of each of the multiple clamping marks, the turned sheet contacts all of the multiple clamping marks simultaneously.

3. The sheet processing apparatus according to claim 2, wherein the multiple clamping portions are arranged such that, when the sheet of the sheet bundle is turned in a direction at an angle with the longitudinal direction of each of the multiple clamping marks, the turned sheet has multiple contacts with the clamping marks.

4. The sheet processing apparatus according to claim 3, wherein each of the multiple clamping portions has a longitudinal length sufficient for the turned sheet to have the multiple contacts with the clamping marks.

5. The sheet processing apparatus according to claim 3, wherein a distance between two adjacent clamping portions is sufficient for the turned sheet to have the multiple contacts with the clamping marks.

6. The sheet processing apparatus according to claim 2, wherein the binding device comprises multiple pairs of tooth units each having the multiple clamping portions, wherein each of the multiple clamping portions includes a linear projection.

7. The sheet processing apparatus according to claim 6, wherein each pair of tooth units further comprises multiple recesses configured to engage the respective linear projections, and the sheet bundle is clamped between the projections and the recesses.

8. An image forming system comprising:

an image forming apparatus; and the sheet processing apparatus according to claim 1.

9. A sheet processing apparatus comprising:

a stacking channel configured to stack multiple sheets into a sheet bundle; and a binding device configured to bind together the sheet bundle, the binding device including multiple clamping portions to clamp the sheet bundle to create multiple clamping marks on the sheet bundle, wherein, when the binding device binds a center area along a binding side of the sheet bundle, a longitudinal direction of each of the multiple clamping marks is substantially perpendicular to the binding side of the sheet bundle, longitudinal ends of the multiple clamping portions are aligned with each other, when the sheet of the sheet bundle is turned in a direction parallel to the longitudinal direction of each of the multiple clamping marks, the turned sheet contacts all of the multiple clamping marks simultaneously, when the sheet of the sheet bundle is turned in a direction at an angle with the longitudinal direction of each of the multiple clamping marks, the turned sheet has multiple contacts with the clamping marks, and the binding device includes multiple pairs of tooth units each having one or more of the multiple clamping portions, each of the multiple clamping portions including a linear projection.

10. The sheet processing apparatus according to claim 9, wherein the multiple clamping portions of the binding device are arranged such that a longitudinal direction of each clamping portion is perpendicular to a sheet width direction perpendicular to a direction in which the sheet bundle is transported in the sheet processing apparatus.

11. The sheet processing apparatus according to claim 9, wherein each of the multiple clamping portions has a longitudinal length sufficient for the turned sheet to have the multiple contacts with the clamping marks.

12. The sheet processing apparatus according to claim 9, wherein a distance between two adjacent clamping portions is sufficient for the turned sheet to have the multiple contacts with the clamping marks.

13. The sheet processing apparatus according to claim 9, wherein each pair of tooth units further comprises multiple recesses configured to engage the respective linear projections, and the sheet bundle is clamped between the projections and the recesses.

14. The sheet processing apparatus according to claim 9, wherein the binding device comprises multiple pairs of tooth units each having the multiple clamping portions, each of which is a linear projection, and multiple recesses configured to engage the respective linear projections, the sheet bundle is clamped between the projections and the recesses, and the multiple pairs of tooth units create the multiple clamping marks at least at a single position symmetrically relative to a centerline of the sheet bundle perpendicular to the binding side thereof.

15. An image forming system comprising:

an image forming apparatus; and the sheet processing apparatus according to claim 9.

* * * * *